US008517493B2

(12) United States Patent
Yamamoto et al.

(10) Patent No.: US 8,517,493 B2
(45) Date of Patent: Aug. 27, 2013

(54) INK JET PRINTING APPARATUS AND PRINT HEAD RECOVERY METHOD

(75) Inventors: Wakako Yamamoto, Sagamihara (JP); Hidehiko Kanda, Yokohama (JP); Hirokazu Tanaka, Kawasaki (JP); Kenichi Oonuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 12/408,096

(22) Filed: Mar. 20, 2009

(65) Prior Publication Data

US 2009/0244161 A1 Oct. 1, 2009

(30) Foreign Application Priority Data

Mar. 25, 2008 (JP) ..... 2008-078911
Feb. 16, 2009 (JP) ..... 2009-033110

(51) Int. Cl.
*B41J 29/38* (2006.01)

(52) U.S. Cl.
USPC ..... 347/14; 347/17; 347/18

(58) Field of Classification Search
USPC .... 347/19, 23, 33–35, 14, 17, 18; 346/140 R
See application file for complete search history.

(56) References Cited

U.S. PATENT DOCUMENTS

| | | | | |
|---|---|---|---|---|
| 4,791,435 | A * | 12/1988 | Smith et al. | 347/17 |
| 5,734,391 | A | 3/1998 | Tanaka et al. | 347/14 |
| 6,033,050 | A * | 3/2000 | Morita et al. | 347/23 |
| 6,193,351 | B1 | 2/2001 | Yaegashi et al. | 347/23 |
| 6,715,855 | B2 | 4/2004 | Oda et al. | 347/35 |
| 6,951,378 | B1 * | 10/2005 | Yamada et al. | 347/18 |
| 2004/0041875 | A1 * | 3/2004 | Yazawa et al. | 347/23 |
| 2005/0270322 | A1 | 12/2005 | Uji et al. | 347/14 |
| 2007/0285467 | A1 | 12/2007 | Tanaka et al. | 347/60 |
| 2008/0143809 | A1 | 6/2008 | Tanaka et al. | 347/194 |
| 2008/0165217 | A1 | 7/2008 | Tanaka et al. | 347/17 |
| 2009/0231380 | A1 | 9/2009 | Terashima et al. | 347/17 |

FOREIGN PATENT DOCUMENTS

| | | | |
|---|---|---|---|
| JP | 63-224958 | 9/1988 | |
| JP | 07-290720 A | 11/1995 | |
| JP | 2001-138538 A | 5/2001 | |
| JP | 2002460384 | 6/2002 | |
| JP | 2005-349607 | 12/2005 | 2/175 |
| WO | 2006/051762 | 5/2006 | 2/14 |

OTHER PUBLICATIONS

Chinese Office Action dated Aug. 12, 2010 in corresponding Chinese Application No. 200910132314.6, with translation.

Mar. 5, 2013 Japanese Office Action in Japanese Patent Application No. 2009-033110.

* cited by examiner

*Primary Examiner* — Lam S Nguyen
(74) *Attorney, Agent, or Firm* — Fitzpatrick, Cella, Harper & Scinto

(57) ABSTRACT

An ink jet printing apparatus and a print head recovery method are provided which effectively execute a preliminary ejection to eject ink not contributing to image printing from nozzle opening of the print head to maintain the ink ejection performance in good condition. The ink in the print head is heated to a first temperature, at which a first preliminary ejection is executed. Then, when the ink temperature falls to a second temperature, which is lower than the first temperature, a second preliminary ejection is executed.

8 Claims, 26 Drawing Sheets

EJECTION FREQUENCY: 15 KHZ

| | NUMBER OF INK EJECTIONS DURING PRELIMINARY EJECTION K1 | | | | |
|---|---|---|---|---|---|
| | 0 | 5,000 | 7,500 | 20,000 | 45,000 |
| CHECK RESULT | × | × | × | × | ○ |

FIG.10A

EJECTION FREQUENCY: 20 KHZ

| | NUMBER OF INK EJECTIONS DURING PRELIMINARY EJECTION K1 | | | | |
|---|---|---|---|---|---|
| | 0 | 5,000 | 7,500 | 20,000 | 45,000 |
| CHECK RESULT | × | × | × | ○ | ○ |

FIG.10B

EJECTION FREQUENCY: 30 KHZ

| | NUMBER OF INK EJECTIONS DURING PRELIMINARY EJECTION K1 | | | | |
|---|---|---|---|---|---|
| | 0 | 5,000 | 7,500 | 20,000 | 45,000 |
| CHECK RESULT | × | ○ | ○ | ○ | ○ |

FIG.10C

| EJECTION FREQUENCY | NUMBER OF INK EJECTIONS DURING PRELIMINARY EJECTION K2 | |
|---|---|---|
| | 500 | 45,000 |
| 5kHz | ○ | ○ |
| 15kHz | × | ○ |
| 30kHz | × | × |

FIG.11

| HEATING HOLD TIME Tc | NUMBER OF INK EJECTIONS DURING PRELIMINARY EJECTION K1 | | | | |
|---|---|---|---|---|---|
| | 0 | 7,500 | 20,000 | 45,000 | 60,000 |
| 0sec | × | × | × | × | ○ |
| 5sec | × | × | × | ○ | ○ |
| 10sec | × | × | ○ | ○ | ○ |

FIG.12

| 1ST TEMP. (HEATING SET TEMP.) | NUMBER OF INK EJECTIONS DURING PRELIMINARY EJECTION K1 | | | | |
|---|---|---|---|---|---|
| | 0 | 7,500 | 20,000 | 45,000 | 60,000 |
| 100°C | X | X | ○ | ○ | ○ |
| 90°C | X | X | X | ○ | ○ |
| 80°C | X | X | X | X | ○ |

FIG.13A

| 2ND TEMP. (COOLING SET TEMP.) | NUMBER OF INK EJECTIONS DURING PRELIMINARY EJECTION K2 | | | | |
|---|---|---|---|---|---|
| | 0 | 7,500 | 20,000 | 45,000 | 60,000 |
| 100°C | X | X | X | X | ○ |
| 90°C | X | X | X | ○ | ○ |
| 80°C | X | X | ○ | ○ | ○ |

FIG.13B

EJECTION FREQUENCY: 15 KHZ

| EJECTION VOLUME | NUMBER OF INK EJECTIONS DURING PRELIMINARY EJECTION K1 | | | | | |
|---|---|---|---|---|---|---|
| | 0 | 5,000 | 7,500 | 20,000 | 45,000 | 100,000 |
| 5pl | X | X | X | X | ○ | ○ |
| 2pl | X | X | X | X | X | ○ |

FIG.16

| EJECTION FREQUENCY | NUMBER OF INK EJECTIONS DURING PRELIMINARY EJECTION K2 | | |
|---|---|---|---|
| | 500 | 3,000 | 45,000 |
| 5kHz | ○ | ○ | ○ |
| 15kHz | ○ | ○ | ○ |
| 30kHz | × | ○ | ○ |

FIG.22

| | RECOVERY RATE OF EJECTION FAILURES DUE TO BUBBLES | RECOVERY RATE OF EJECTION FAILURES DUE TO VISCOUS INK CLOGGING | TOTAL OF RECOVERY RATES |
|---|---|---|---|
| HEATING-BASED RECOVERY OPERATION (STEP 2304) | 6/6 | 0/2 | 6/8 |
| SUCTION-BASED RECOVERY OPERATION (STEP 2305) | 6/6 | 2/2 | 8/8 |

FIG.24

INK JET PRINTING APPARATUS AND PRINT HEAD RECOVERY METHOD

BACKGROUND OF THE INVENTION

1. Field of the Invention

The present invention relates to an ink jet printing apparatus to print an image using an ink ejection print head and a recovery method to keep an ink ejection performance of the print head in good condition.

2. Description of the Related Art

A recovery operation to keep the ink ejection from nozzle openings of the print head in normal condition has conventionally been performed in ink jet printing apparatus. The recovery operation can discharge viscous ink and minute ink bubbles from the print head and remove foreign matters and ink mist adhering to a surface of the print head where nozzle openings are formed. The recovery operation is known to include a suction operation, a preliminary ejection operation, a wiping operation and a heating operation, for example.

Ink bubbles, when formed in the nozzle openings of the print head in particular, may cause ink ejection anomalies, such as ink ejection failures, a deflection of ink ejecting direction and reduced ink ejection volumes. Such phenomena can be observed when a print head is applied small vibrations and impacts as it is mounted on an ink jet printing apparatus, and when it falls. In such cases, conventional recovery operation involves first sucking out ink bubbles from the nozzle openings of the print head and then executing a preliminary ejection.

The preliminary ejection operation is an operation to discharge residual ink and bubbles from the nozzle openings of the print head by ejecting ink not used for image printing out onto a predetermined location outside a print medium. The preliminary ejection operation following the suction operation is intended to remove color inks that are mixed together during the suction operation. The suction operation sucks out ink and bubbles from the nozzle openings of the print head by a negative pressure generated by a pump for example. During a general suction operation, the nozzle openings of the print head are hermetically closed by a cap into which a negative pressure is introduced to suck out ink and bubbles from the print head out into the cap. Japanese Patent Laid-Open No. 63-224958 discloses a method for suction operation which involves pressing an elastic cap against the nozzle opening-formed surface of the print head, increasing the pressure in the cap, releasing the interior of the cap to the open air and then introducing a negative pressure into the cap.

However, the suction operation to suck out bubbles from the nozzle openings of the print head as described above requires a suction mechanism such as a negative pressure pump, leading to increased complexity and cost of the apparatus as a whole. Further, in printing highly defined images such as photographs, a print head that ejects smaller volumes of ink is required. Such a print head has an increased flow resistance in ink paths communicating with the nozzle openings because of reduced cross sections of the ink paths. For the suction operation to be effectively performed on such a print head, therefore, the negative pressure introduced into the cap needs to be enhanced significantly to create a fast enough ink flow to suck out bubbles from the nozzle openings. The increased suction force necessarily increases the volume of waste ink sucked out of the nozzle openings, which in turn may reduce the volume of ink available for use in printing.

Japanese Patent Laid-Open No. 2002-160384 describes a heating operation as a recovery operation. The heating operation boils the ink in individual ink paths communicating to the nozzle openings by using heating elements. The heated ink inflates bubbles adhering to the common liquid chamber communicating with individual ink paths and thereby discharges the bubbles from the common liquid chamber out into an ink supply chamber.

Though it does not lead to an increased complexity of the apparatus as a whole as does the suction operation, or to a higher cost and an increased volume of waste ink, the above heating operation has exhibited a low level of performance in removing bubbles adhering to nozzle ends.

SUMMARY OF THE INVENTION

The present invention provides an ink jet printing apparatus and a print head recovery method that effectively perform preliminary ejections by ejecting ink not contributing to image printing from the nozzle openings of the print head to maintain an ink ejection performance in good condition.

In the first aspect of the present invention, there is provided an ink jet printing apparatus to print an image using a print head capable of ejecting ink from a nozzle opening thereof, the ink jet printing apparatus comprising: a detection unit that detects a temperature of ink in the print head; and a heating unit that heats the ink in the print head, wherein the heating unit heats the ink in the print head to a first temperature, at which a first preliminary ejection to eject ink not contributing to image printing from the nozzle opening is executed, then, when the temperature in the print head falls to a second temperature, which is lower than the first temperature, a second preliminary ejection to eject ink not contributing to image printing from the nozzle opening is executed.

In the second aspect of the present invention, there is provided a recovery method to keep an ink ejection performance of a print head in good condition in an ink jet printing apparatus, wherein the ink jet printing apparatus prints image using the print head capable of ejecting ink from a nozzle opening thereof, the recovery method comprising the steps of: heating ink in the print head to a first temperature and executing a first preliminary ejection at the first temperature to eject ink not contributing to image printing from the nozzle opening; and then, when the temperature in the print head falls to a second temperature, which is lower than the first temperature, executing a second preliminary ejection to eject ink not contributing to image printing from the nozzle opening.

With this invention, the preliminary ejection can be executed effectively by increasing an ink temperature in the print head to a first temperature followed by executing a first preliminary ejection and then, when the ink temperature falls below the first temperature, executing a second preliminary ejection. As a result, the performance of removing bubbles adhering to the nozzle ends can be enhanced without increasing the complexity of the construction of the printing apparatus as a whole, or increasing the cost or the volume of waste ink, thus keeping the ink ejection performance in good condition.

Further features of the present invention will become apparent from the following description of exemplary embodiments (with reference to the attached drawings).

BRIEF DESCRIPTION OF THE DRAWINGS

FIG. 10A, FIG. 10B and FIG. 10C are explanatory tables showing relations among an ejection frequency, the number of ejections executed and a recovery effect observed during a preliminary ejection K1 of FIG. 7;

FIG. 11 is an explanatory table showing a relation among an ejection frequency, the number of ejections executed and a recovery effect observed during a preliminary ejection K2 of FIG. 7;

FIG. 12 is an explanatory table showing a relation among the number of ejections executed, a recovery effect observed and a heating hold time during the preliminary ejection K1 of FIG. 7;

FIG. 13A is an explanatory table showing a relation among the number of ejections executed, a recovery effect observed and a heating set temperature during the preliminary ejection K1 of FIG. 7;

FIG. 13B is an explanatory table showing a relation among an ejection frequency, the number of ejections executed and a cooling set temperature during the preliminary ejection K1 of FIG. 7;

FIG. 16 is an explanatory table showing a relation among an ejection volume, the number of ejections executed and a recovery effect observed during the preliminary ejection K1 in the second embodiment of this invention;

FIG. 22 is an explanatory table showing a relation among an ejection frequency, the number of ejections executed and a recovery effect observed during a preliminary ejection K2 in the fourth embodiment of this invention;

FIG. 24 is an explanatory table showing an effect of the recovery operation in the fifth embodiment of this invention;

DESCRIPTION OF THE EMBODIMENTS

Now, embodiments of this invention will be described by referring to the accompanying drawings.

First Embodiment

FIG. 1 to FIG. 13B represent the first embodiment of this invention. The first embodiment of this invention will be explained in four separate sections: (mechanical construction of the printing apparatus), (control system configuration in the printing apparatus), (construction of an ink jet cartridge) and (recovery operation).

(Mechanical Construction of the Printing Apparatus)

Figure 1:
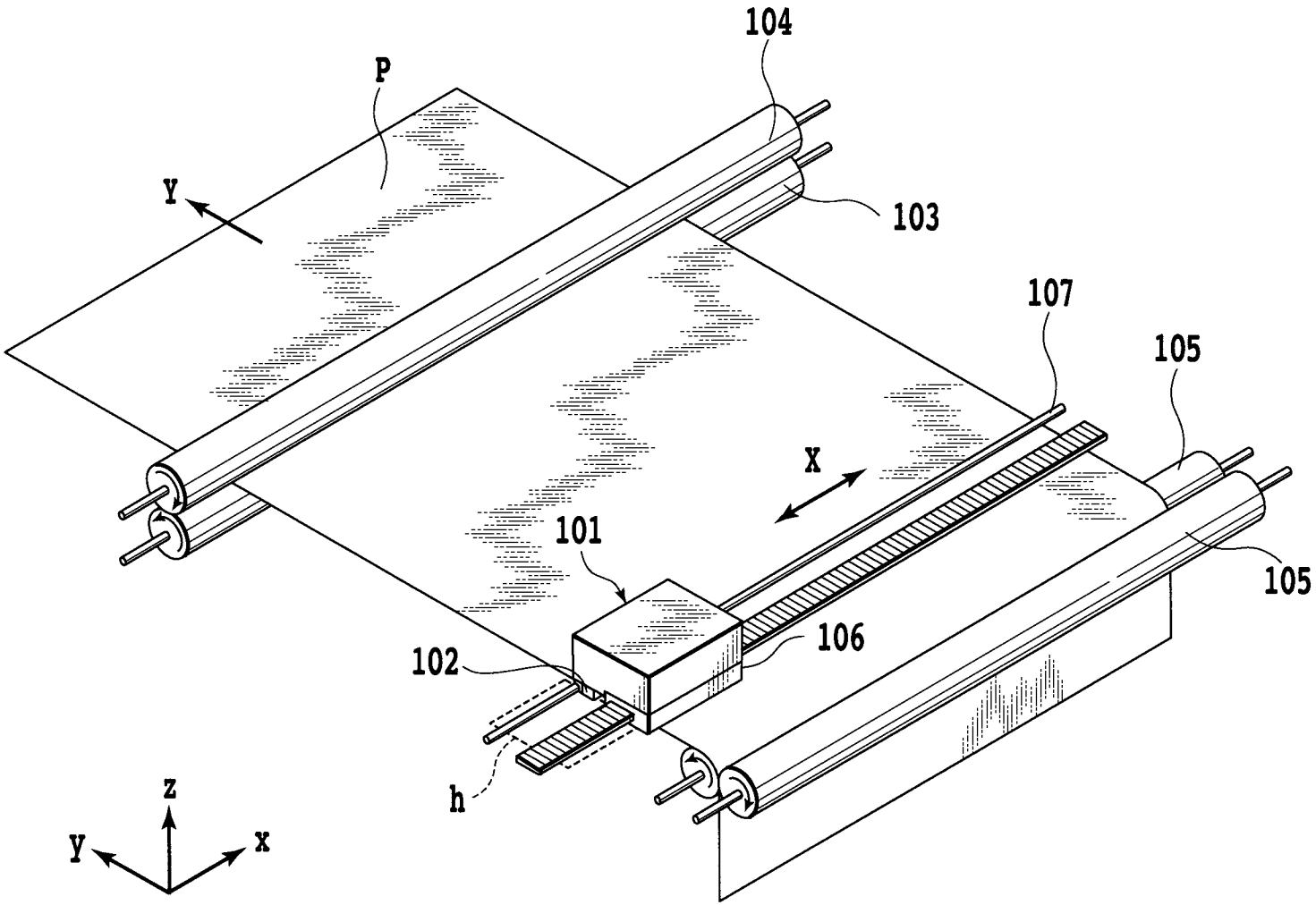
FIG. 1 is a schematic perspective view of an ink jet printing apparatus according to a first embodiment of this invention.

FIG. 1 is a schematic perspective view of a serial type ink jet printing apparatus capable of applying the present invention. The serial type ink jet printing apparatus forms an image on a print medium P by repetitively performing a printing scan operation of an ink jet print head 102 and a feed operation of the print medium P. The printing scan operation is an operation (main scanning) that causes the print head 102 to eject ink from its nozzle openings while moving the print head 102 in a main scan direction indicated by arrow X. The feed operation is an operation (sub scanning) that moves the print medium P in a subscan direction of arrow Y crossing (in this example, perpendicularly) the main scan direction. The print head 102 of this example forms, along with an ink tank, a head cartridge 101. The ink tank separately accommodates cyan, magenta and yellow dye ink and the print head 102 can eject these inks from a plurality of nozzle openings.

Denoted 103 is a transport roller 103 that is rotated by a drive motor not shown. The transport roller 103 holds the print medium P between it and an opposing auxiliary roller 104 and is rotated intermittently in response to the reciprocal movement of the carriage explained later. As a result the print medium P is fed a predetermined distance at a time in the subscan direction. Denoted 105 is a pair of supply rollers to supply the print medium P toward the transport roller 103. The pair of supply rollers 105 hold the print medium P between them and rotate to feed the print medium P in the subscan direction, in combination with the rotating action of the transport roller 103 and the auxiliary roller 104.

Designated 106 is a carriage to detachably hold the head cartridge 101. The carriage 106 is reciprocally moved by a carriage motor along a guide shaft 107 extending in the main scan direction. The carriage 106, when not performing the printing operation or when performing the recovery operation on the print head 102, moves to a home position h indicated by a dashed line in FIG. 1 where it stands by.

When a print start command is entered, the print head 102 of the head cartridge 101 ejects ink from a plurality of ejection nozzles as the carriage 106, that was standing by at the home position h before the start of the printing operation, moves in the main scan direction. When the printing operation based on print data for one scan is complete, the carriage 106 returns to the home position. After this, the carriage 106 performs the printing operation according to the next print data as it moves in the main scan direction again.

(Control System Configuration in the Printing Apparatus)

Figure 2:
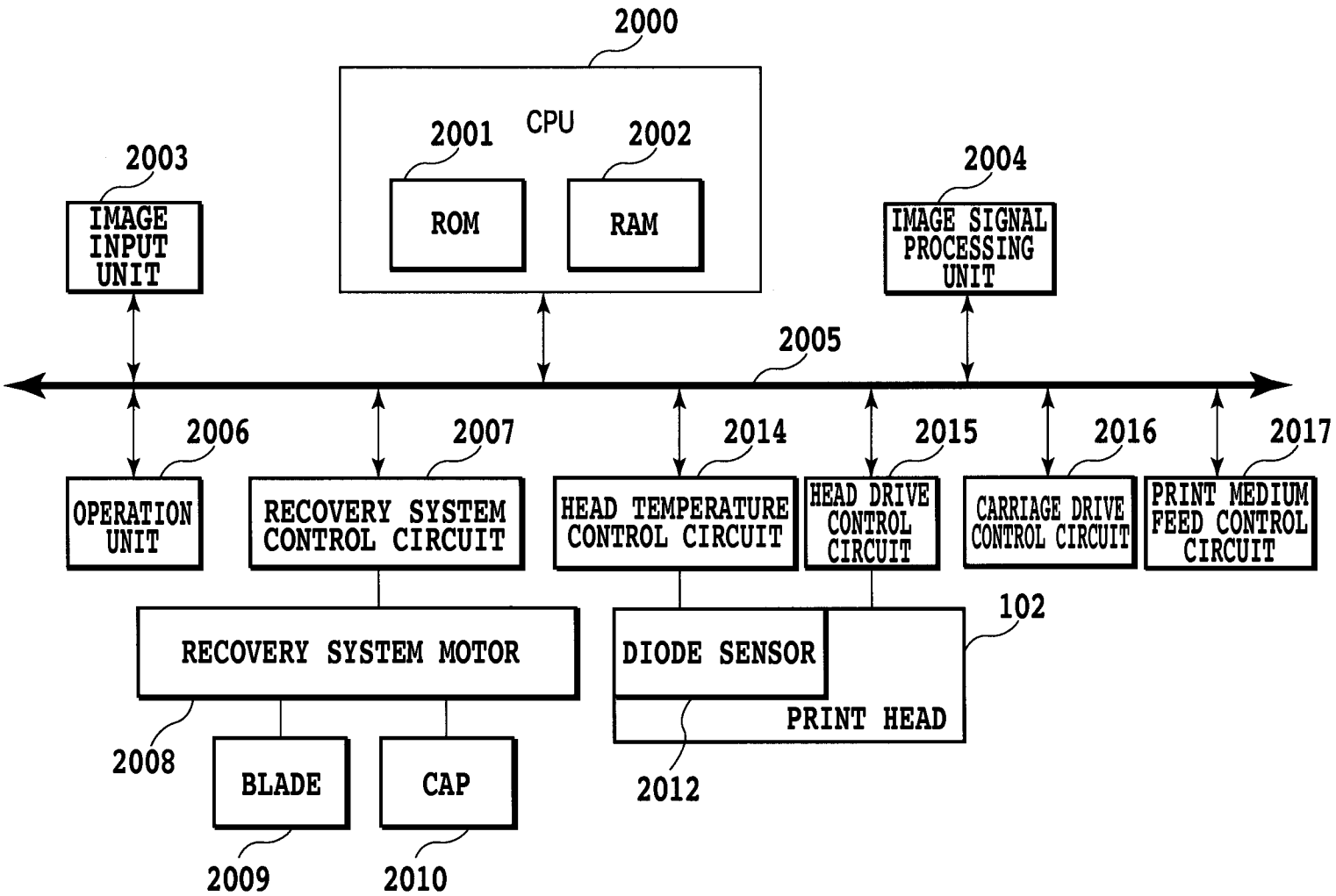
FIG. 2 is a block diagram showing a control system in the ink jet printing apparatus of FIG. 1.

FIG. 2 is a block configuration diagram of a control system in the ink jet printing apparatus.

In FIG. 2, a main bus line 2005 is connected with software processing means (unit), such as an image input unit 2003, an image signal processing unit 2004 and a central control unit CPU 2000. The main bus line 2005 is also connected with hardware processing means (unit), such as an operation unit 2006, a recovery system control circuit 2007, a head temperature control circuit 2014, a head drive control circuit 2015, a carriage drive control circuit 2016 and a print medium feed control circuit 2017.

The CPU 2000 has a ROM 2001 and a RAM 2002. The ROM 2001 stores a program to control various devices such as the image input unit 2003, the image signal processing unit 2004 and the head drive control circuit 2015. The RAM 2002 functions as a work area in which to process a variety of data. The CPU 2000 according to the program stored in the ROM 2001 controls various devices through the main bus line 2005, such as the image input unit 2003, the image signal processing unit 2004 and the head drive control circuit 2015.

The image input unit 2003 receives image data from external devices not shown (such as a host computer and a digital camera) connected to the ink jet printing apparatus. The image signal processing unit 2004 under the control of the CPU 2000 binarizes (by a dot pattern setting operation) the image data supplied to the image input unit 2003 into binary image data.

The head drive control circuit 2015 under the control of the CPU 2000 controls the operation of print elements (ejection energy generation elements) to eject ink from nozzle openings of the print head 102. More specifically, the head drive control circuit 2015 drives the print elements according to the binary image data generated by the image signal processing unit 2004. This causes an image represented by the binary image data to be printed on a print medium. In this example, the print elements are electrothermal conversion elements (heaters). The print elements are not limited to the heaters and may use piezoelectric elements.

The recovery system control circuit 2007, according to a recovery program stored in the ROM 2001, drives the recovery system motor 2008 to control the recovery operation performed on the ink jet printing apparatus. The recovery system motor 2008, according to a control signal from the recovery system control circuit 2007, drives a cleaning blade 2009 and a cap 2010 both provided at a position where they can face the print head 102.

The print head 102 has a board in which heating elements capable of heating the print head are embedded. This board is provided with a diode sensor 2012 to measure a temperature of the print head 102. Since in a practical construction an ink temperature in the print head 102 is difficult to measure, the print head temperature measured by the diode sensor 2012 is used as the ink temperature. The head temperature control circuit 2014, based on the head temperature detected by the diode sensor 2012, controls the operation of the ink ejection print elements (ejection energy generation elements) to adjust the temperature of the print head 102.

(Construction of Head Cartridge)

Figure 3:
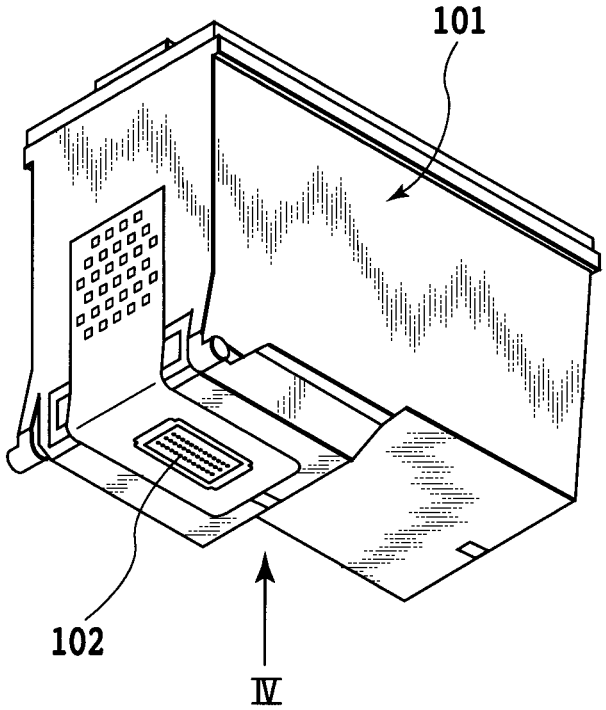
FIG. 3 is a perspective view of a head cartridge of FIG. 1.
Figure 4:
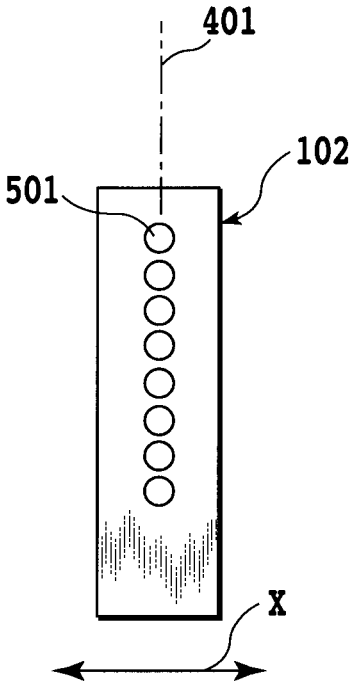
FIG. 4 is a schematic view showing an arrangement of nozzle openings formed in the print head of FIG. 3.

FIG. 3 is a perspective view of the head cartridge 101. FIG. 4 is a conceptual view showing an arrangement of nozzle openings 501 in the print head 102 forming the head cartridge 101 and corresponds to an enlarged view of the nozzle openings 501 in the print head 102 as seen from the direction of arrow IV of FIG. 3. In FIG. 4, only eight nozzle openings, each designed to eject an ink droplet about 5 pl in volume at a time, are shown to form an array of nozzle openings or nozzle array 401.

Figure 5:
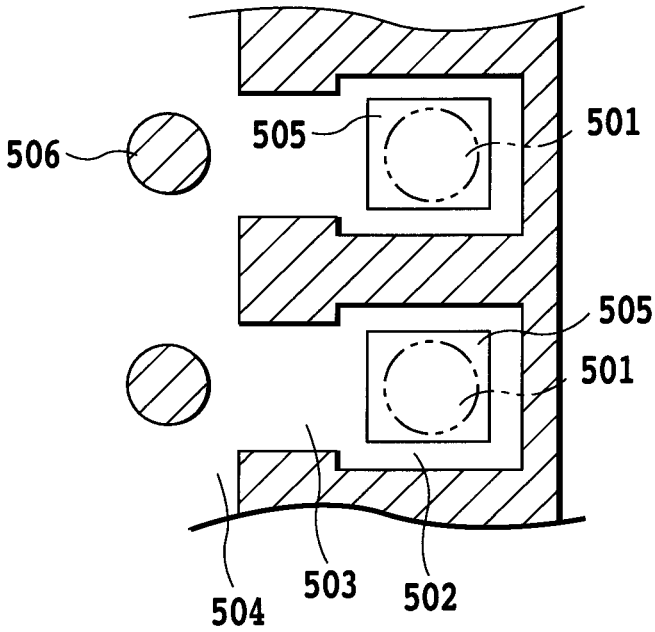
FIG. 5 is an enlarged cross-sectional view of a nozzle opening portion of FIG. 4.

FIG. 5 is a cross section of a structure including the nozzle openings 501, which eject ink from the back of the sheet of FIG. 5 toward the front. The nozzle openings 501 in this example each have an opening area through which 5 pl of ink droplet can be ejected. More specifically, they are each formed circular 16.4 μm in diameter. The sizes of bubble chambers 502 and ink paths 503, both communicating to each nozzle opening 501, and the size of the heaters (electrothermal conversion elements) 505 installed in each bubble chamber 502 are adjusted according to the size of the nozzle openings 501. Each of the heaters 505 as ink ejection energy generation elements is installed in the individual bubble chambers 502 in such a way as to oppose the associated nozzle opening 501. Driving the heaters 505 so as to produce the heat to create a bubble in the ink in the individual bubble chambers 502 can cause an ink droplet to be ejected from the nozzle openings 501 by an energy of the expanding bubbles.

More precisely, the bubble chamber 502 is 29 μm wide and the ink path 503 22.5 μm wide. The heater 505 is rectangular in shape measuring 19.4×21.6 μm. A common liquid chamber 504 is supplied with ink from an ink supply port not shown. A nozzle filter 506 composed of pillars is installed in the common liquid chamber 504 to trap extraneous substances or dirt in the ink supplied. The print head 102 that forms a part of the head cartridge 101 has its nozzle openings 501 closed with a protective tape (not shown) when shipped.

(Recovery Operation)

Figure 6:
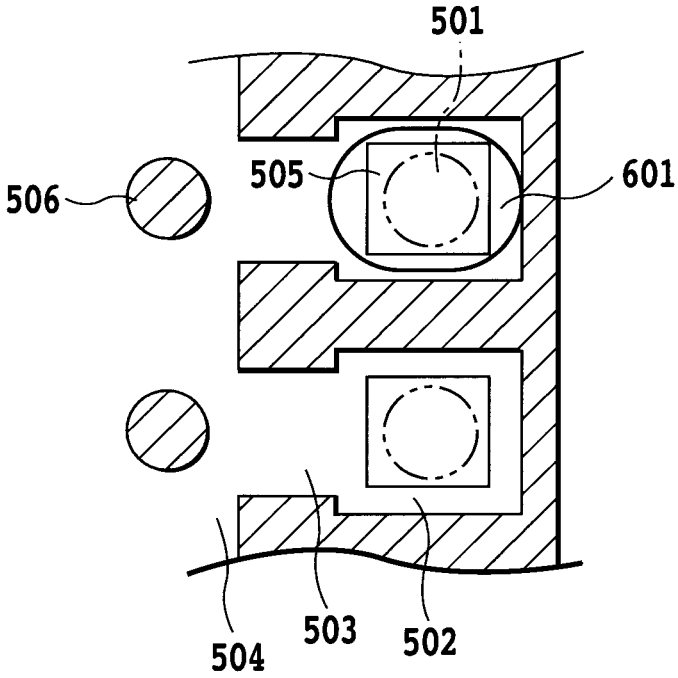
FIG. 6 is an enlarged cross-sectional view showing a bubble formed in the nozzle opening portion of FIG. 5.

FIG. 6 is a schematic view showing an abnormal bubble 601 formed in the bubble chamber 502.

Abnormal bubbles 601 are formed when the print head 102 is subjected to small vibrations or impacts during its mounting in the ink jet printing apparatus or when the print head 102 falls to ground. Measurements were taken of an impact applied to the head cartridge 101 when it falls from a desk top 60 cm high. It was an acceleration of approximately 100 G. Bubbles 601, when formed, are likely to result in an ink ejection failure.

Figure 7:
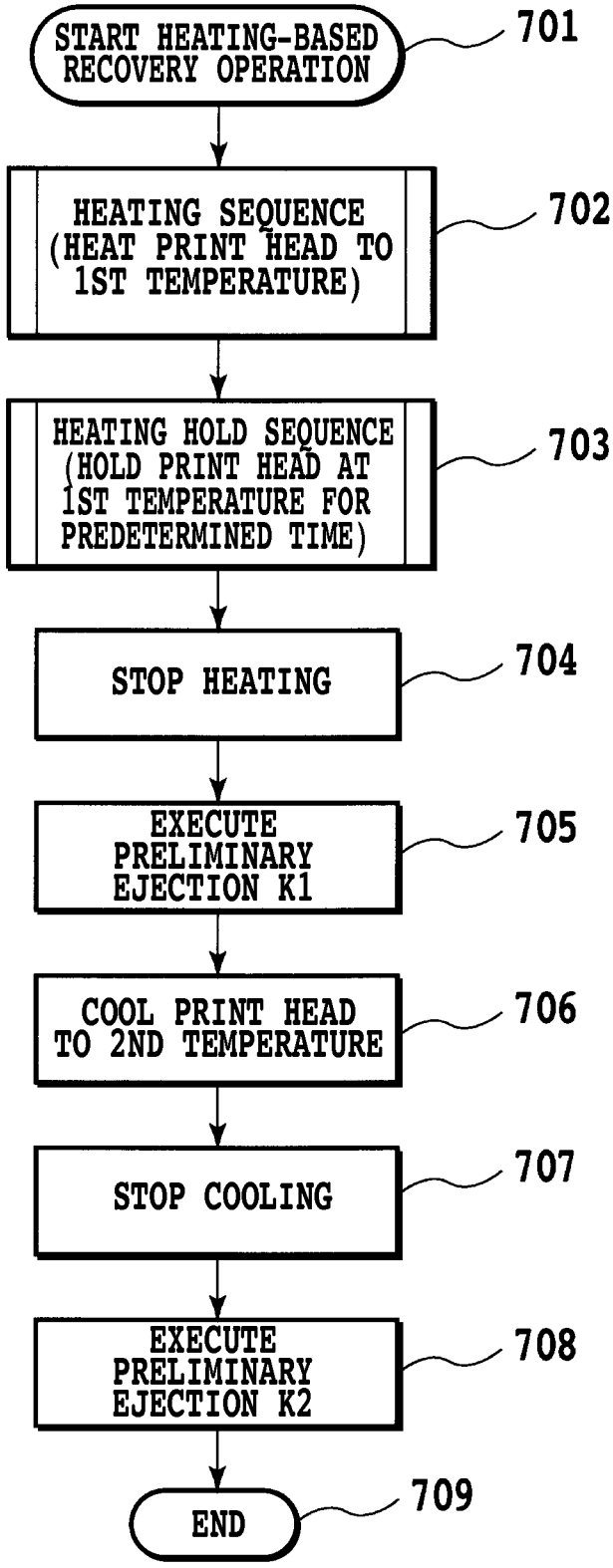
FIG. 7 is a flow chart explaining a heating-based recovery operation in the first embodiment of this invention.

FIG. 7 is a flow chart showing a sequence of steps when a heating-based recovery operation is executed to recover a normal ink ejection state. The recovery operation is performed when the print head is renewed, when the existing print head is dismounted and remounted and when an ink ejection failure is found to be caused by the bubble 601. The ink ejection failure may be detected by the user printing a test pattern or by an optical sensor reading the state of a preliminary ejection.

At step 701 a heating-based recovery operation is started. Step 702 executes a heating sequence to heat the print head 102 to a first temperature (heating set temperature). Then, at step 703 a heating hold sequence is executed to keep the print head 102 at the first temperature for a predetermined time (heating hold time). In this example, the heating hold time is five seconds. Then at step 704, the heating of the print head 102 is stopped. Immediately after this, the print head 102, which is at the first temperature, is made to preliminarily eject ink (step 705). The preliminary ejection is a recovery operation that heats the heaters 505 to cause the ink not contributing to image printing to be ejected from the nozzle openings 501. The preliminary ejection at step 705, i.e., the preliminary ink ejection from the print head 102 at the first temperature, is hereinafter referred to as a "preliminary ejection K1" or a "first preliminary ejection."

Next, with the temperature of the print head 102 constantly checked with the diode sensor 2012, the print head 102 is cooled to a second temperature (cooling set temperature) (step 706). Then, when the print head 102 is cooled to the second temperature, the cooling of the print head 102 is stopped (step 707) and a preliminary ink ejection is performed from the print head 102 at the second temperature (step 708). The preliminary ejection at step 708, i.e., the preliminary ink ejection from the print head 102 at the second temperature, is hereinafter referred to as a "preliminary ejection K2" or a "second preliminary ejection." After the preliminary ejection K2 is executed, the heating-based recovery operation is ended (step 709).

In this example, the second temperature (cooling set temperature) is 50° C., to which the print head 102 is cooled by natural heat dissipation. If the print head 102 is cooled positively by cooling means (unit), the cooling operation using the cooling means is stopped at step 707.

Figure 25:
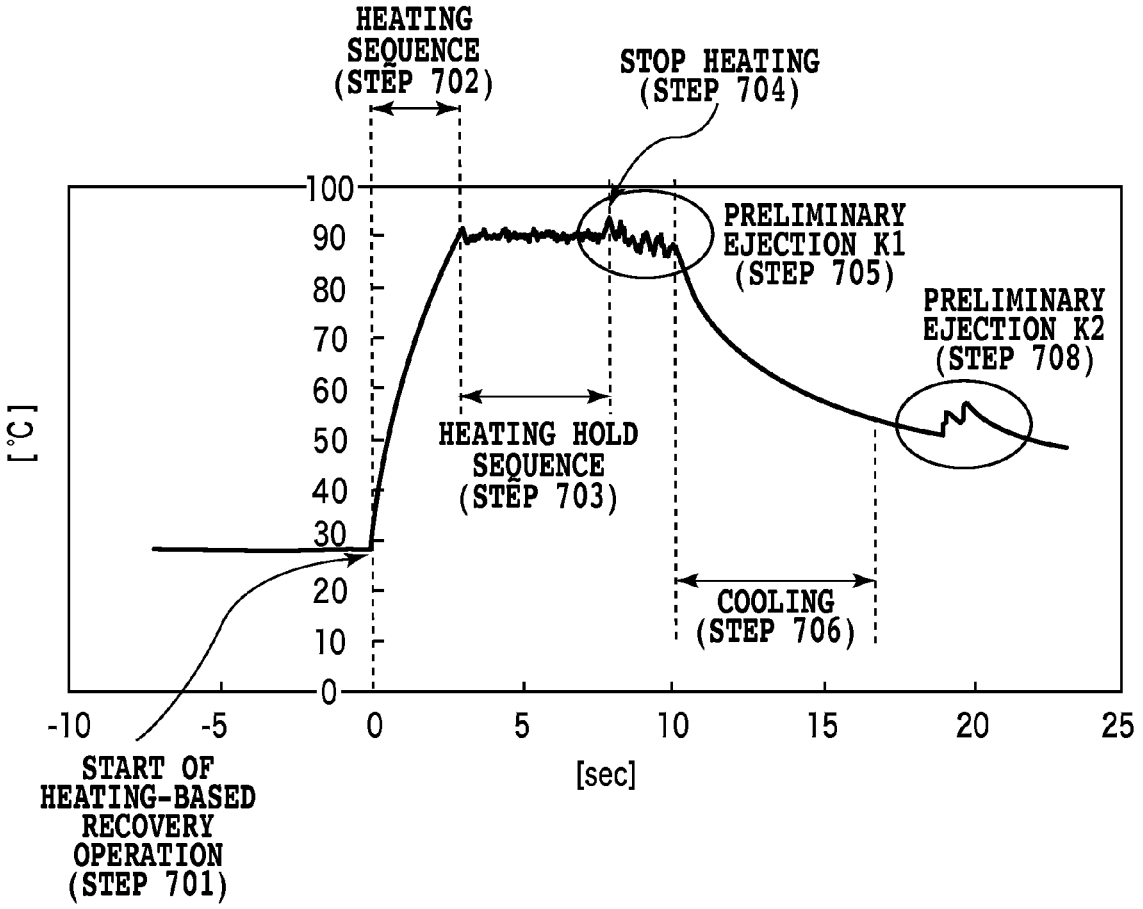
FIG. 25 is a graph showing a temperature change in the print head during the heating hold sequence.

Here, how bubbles 601 are removed in the heating-based recovery operation will be explained by referring to FIG. 25 and FIGS. 26A to 26G. FIG. 25 is a graph showing a temperature change in the print head 102 during the recovery operation shown in the flow chart of FIG. 7. FIGS. 26A to 26G show how a plurality of abnormal bubbles 601 that have occurred in the bubble chamber 502 behave in each step of the flow chart of FIG. 7.

Figure 26A:
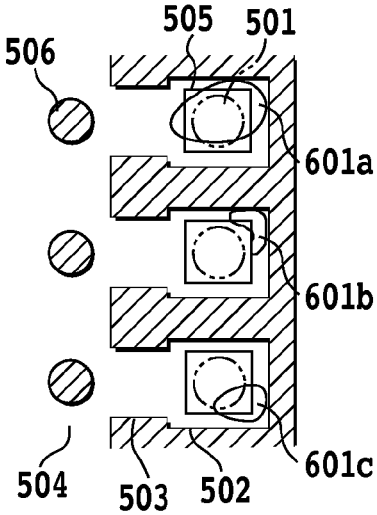
FIG. 26A to FIG. 26G show how a bubble in the print head changes with each step of the heating hold sequence.

FIG. 26A shows bubbles 601 formed when the heating-based recovery operation of FIG. 25 is started. Here three bubbles of different sizes 601*a*, 601*b*, 601*c* are shown to be formed.

Figure 26B:
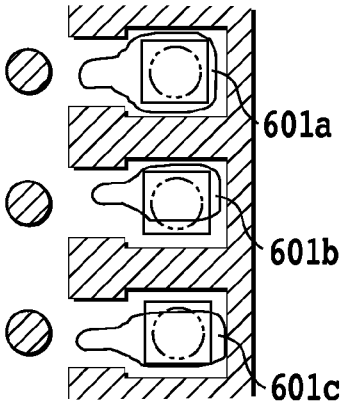

FIG. 26B shows the bubbles 601 during the heating sequence of FIG. 25. As the print head 102 is heated to the first temperature (heating set temperature), the bubbles 601*a*, 601*b*, 601*c* expand in the bubble chambers 502 toward the ink paths 503.

Figure 26C:
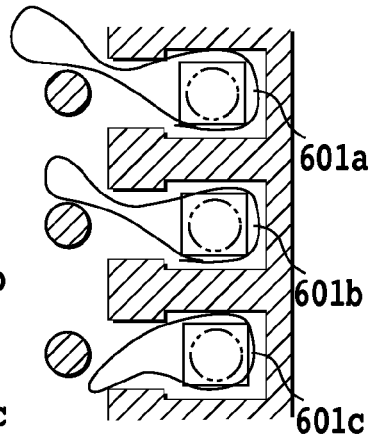

FIG. 26C shows the bubbles 601 when the heating is continued further. The bubbles continue to inflate, passing through the nozzle filter 506 and entering into the common liquid chamber 504, until the heating is stopped.

Figure 26D:
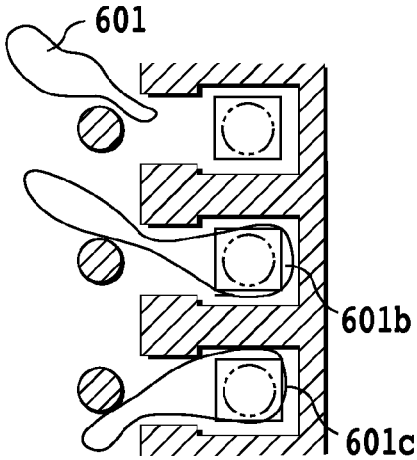

FIG. 26D shows only the bubble 601*a* to have been removed before the heating is stopped. The bubble 601*a*, larger than others, is completely removed from the bubble chamber 502 upon moving into the common liquid chamber 504, whereas the bubbles 601*b*, 601*c* are shown to have not been removed before the heating is stopped.

Figure 26E:
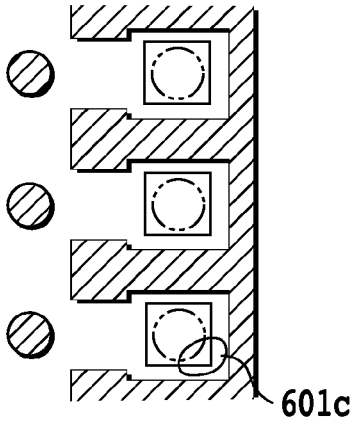

FIG. 26E show the bubbles 601*b*, 601*c* when the preliminary ejection K1 is executed immediately after the heating is stopped in FIG. 25. Of the bubbles 601*b*, 601*c* remaining before the preliminary ejection K1, only the bubble 601*b* was removed by the preliminary ejection K1 with the bubble 601*c* still remaining. That is, the bubble 601*c* was not large enough to be removed only by the heating but grew as a result of heating to such an extent that it could no longer be discharged by the preliminary ejection K1. On the contrary, the bubble 601*b*, the smallest among them, did not grow so large by the heating and therefore was able to be discharged by the preliminary ejection K1.

Figure 26F:
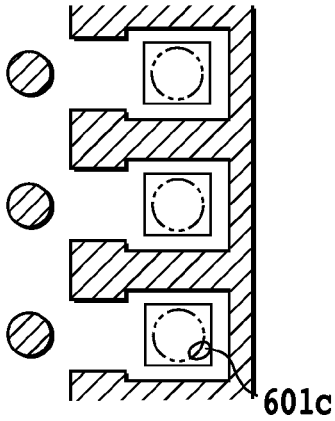

FIG. 26F show the bubble 601*c* when the print head 102 is cooled to a second temperature (cooling set temperature) as shown in FIG. 25. The bubble 601*c* still remaining after the preliminary ejection K1 has become far smaller than its original size of FIG. 25A as a result of cooling.

Figure 26G:
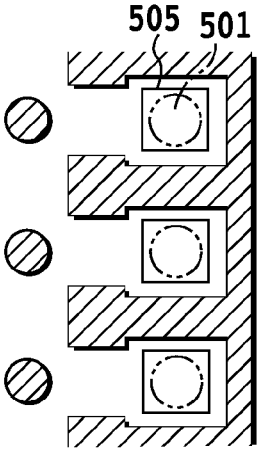

FIG. 26G show that the bubble 601*c* that has contracted in size is completely removed by the preliminary ejection K2 of FIG. 25.

As described above, the large bubble 601*a* can be removed only by heating; the smallest bubble 601*b* can be removed by the preliminary ejection K1; and the still remaining bubble 601*c* is contracted from its original size by cooling and then can be removed completely by the preliminary ejection K2.

Figure 8:
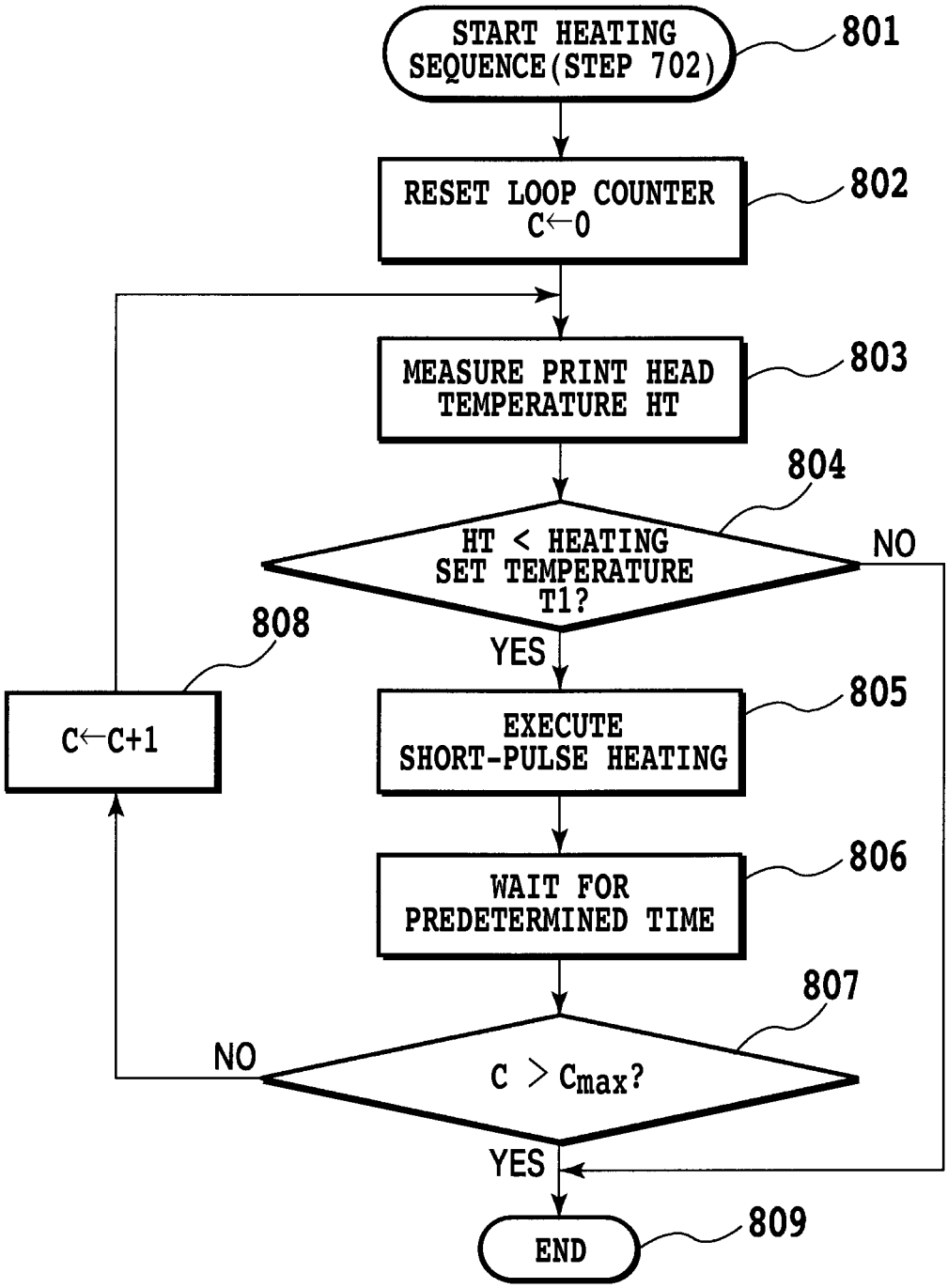
FIG. 8 is a flow chart explaining a heating sequence in FIG. 7.

FIG. 8 is a flow chart explaining the heating sequence (step 702) of FIG. 7. In the heating sequence of this example, short drive pulses are applied to the heaters 505 to raise the temperature HT of the print head 102 to the first temperature (heating set temperature) T1. This operation of heating the print head 102 by applying short pulses to the heaters 505 is hereinafter referred to also as a "short pulse heating". In this example, the first temperature (heating set temperature) T1 is set at 90° C.

At step 801 the heating sequence is started. Then at step 802 the loop counter C is reset to "0". At step 803 a temperature of the print head 102 (referred to as a "head temperature") HT is read by the diode sensor 2012. Then at 804 the head temperature HT is compared with the heating set temperature T1. If the condition of (head temperature HT<heating set temperature T1) is met, the processing moves to step 805. If not, the heating sequence is ended (step 809).

Step 805 executes the short pulse heating to apply short pulses to the heaters 505 to heat them. In this example, the heating operation is done by applying to the heaters 505 short pulses 0.3 μs wide at a drive frequency of 30 kHz for a predetermined period of time (270 ms). Then, the sequence waits for a predetermined duration (30 ms) at step 806, after which step 807 compares the loop counter C with the predetermined maximum count value Cmax. If the condition of C>Cmax is met, the heating sequence is ended (step 809). If not, the loop counter C is incremented by "1" (step 808) before the sequence returns to step 803.

Figure 9:
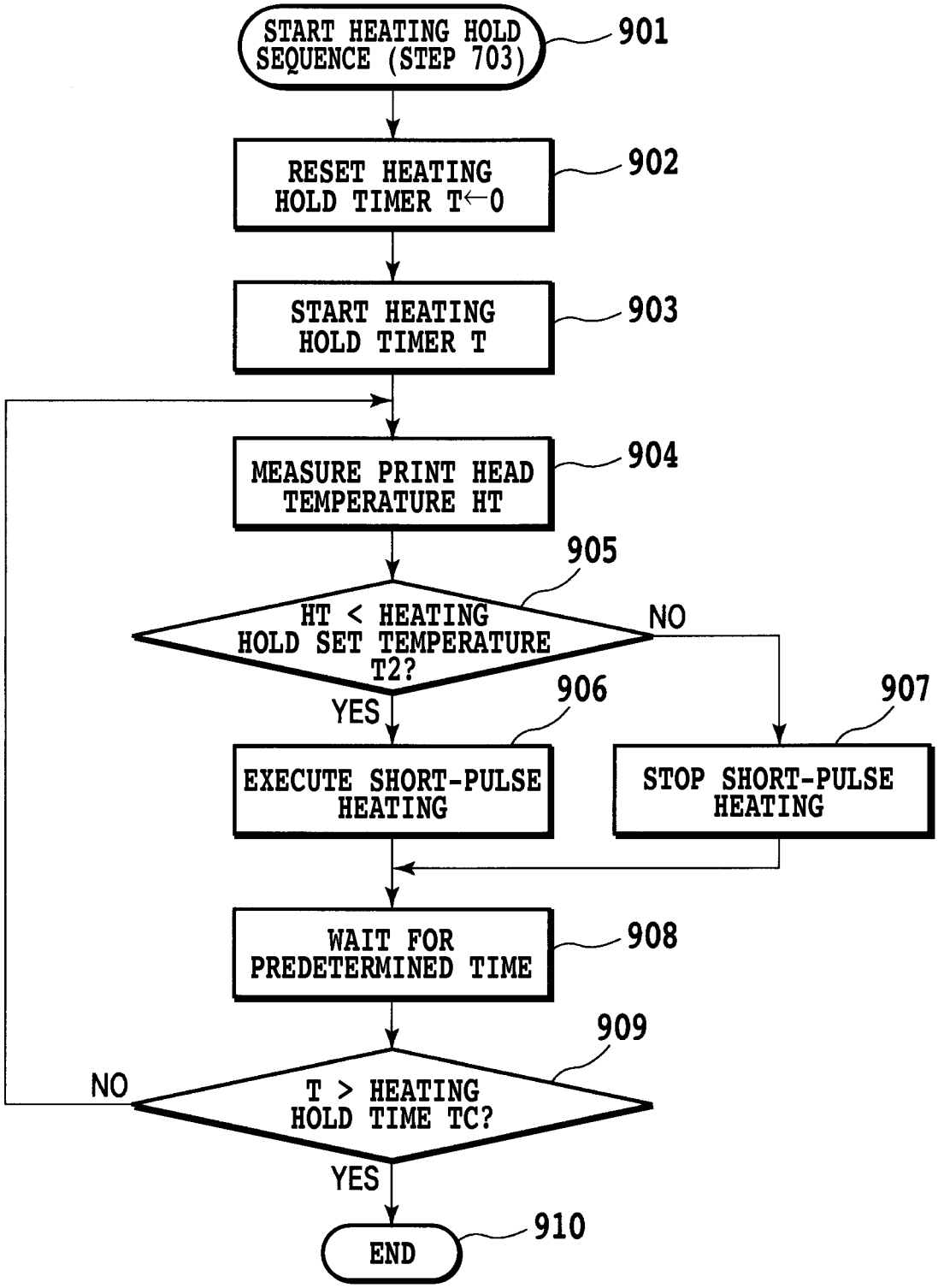
FIG. 9 is a flow chart explaining a heat holding sequence in FIG. 7.

FIG. 9 is a flow chart explaining the heating hold sequence (step 703) of FIG. 7. In this example, the heating hold time during which to keep the print head 102 at the heating set temperature is 5 seconds.

At step 901 the heating hold sequence is started. The sequence resets the heating hold timer T to "0" at step 902 before starting it at step 903. Then at step 904 the sequence reads the head temperature HT using the diode sensor 2012 and, at step 905, compares the head temperature HT with the heating hold set temperature T2. The heating hold set temperature T2 is a temperature at which the print head 102 is held for a predetermined period of time and which has been described in FIG. 7 as the first temperature equal to the heating set temperature T1. In this example, the heating hold set temperature T2 is 90° C., equal to the heating set temperature T1. These set temperatures T1, T2 may be different from each other.

If the condition of (head temperature HT<heating hold set temperature T2) is satisfied, the sequence moves to step 906 where it executes the short pulse heating (in this example, the pulse is 80 ms wide) under the same drive condition as step 805. If the condition is not met, the sequence moves to step 907 where it stops the short pulse heating for a predetermined period (in this example, 0 second).

Then, at step 908 the sequence waits for a predetermined period (in this example, 30 ms) and, at step 909, compares the value of the heating hold timer T and the predetermined heating hold time Tc. If the condition of T>Tc is met, the heating hold sequence is ended (step 910). If not, it returns to step 904.

The recovery of the ink ejection performance of the print head 102 brought about by the heating-based recovery operation of FIG. 7 was checked.

The print head 102 in which bubbles 601 were formed as shown in FIG. 6 was subjected to the heating-based recovery operation of FIG. 7. In some of eight nozzle openings 501 constituting the nozzle array 401, bubbles 601 were formed, ranging in number from one to eight depending on the magnitude of the impact applied to the print head 102. After the heating-based recovery operation was performed on the print head 102, a predetermined pattern was printed to check how well the ink ejection performance was recovered. The print pattern used is such as will allow checking for a success or failure of ink ejection and a deflection of ink ejecting direction for each nozzle opening 501.

FIGS. 10A, 10B and 10C show check results on the ejection performance recovery of the print head 102 when the ejection frequency and the number of ink ejections are changed during the preliminary ejection K1 at step 705 of FIG. 7. In the preliminary ejection K2 at step 708 of FIG. 7, the ink ejection frequency and the number of ink ejections are set constant at 15 kHz and 45,000 ejections respectively. Marking "○" in FIG. 10A, FIG. 10B and FIG. 10C means that the bubbles 601 formed in the nozzle openings 501 were all removed and that the ink ejection performance has recovered. Marking "x" in these figures means that not all bubbles were removed and that the ink ejection performance has failed to be recovered.

FIG. 10A shows a check result on the ejection performance recovery when the ejection frequency of the preliminary ejection K1 is set at 15 kHz equal to the one used for printing. FIG. 10B and FIG. 10C represent recovery check results when the ejection frequency of the preliminary ejection K1 is set at 20 kHz and 30 kHz, respectively. These check results have found that while the ejection performance of the print head is not recovered when the number of ejections during the preliminary ejection K1 is 0, the performance recovery improves as the number of ejections increases.

In this example, as described above, the electrothermal conversion elements (heaters) originally intended for ink ejection are used as heating means (unit) to heat the print head to the first temperature of 90° C. at which the print head is kept for five seconds. Then, the print head at the first temperature is made to execute the preliminary ejection K1 and is cooled through natural heat dissipation to the second temperature of 50° C., which is lower than the first temperature. Then, the print head at the second temperature is made to perform the preliminary ejection K2.

Next, (1) the condition of the preliminary ejection K1 at the first temperature, (2) the condition of the preliminary ejection K2 at the second temperature, (3) the overheating hold time and (4) the heating set temperature will be explained.

(1) Condition of Preliminary Ejection K1 at First Temperature

As shown in FIGS. 10A, 10B and 10C, the ejection frequency and the number of ejections during the preliminary ejection K1 in step 705 of FIG. 7 were changed. In that case, during the preliminary ejection K2 in step 708 of FIG. 7, the ejection frequency of preliminary ejection was held constant at 15 kHz and the number of ejections at 45,000.

As shown in FIG. 10A, during the preliminary ejection K1 with an ejection frequency of 15 kHz, 45,000 ejections were required to recover the print head ejection performance. However, during the preliminary ejection K1 with an ejection frequency of 20 kHz of FIG. 10B, the number of ejections required for recovery was 20,000. During the preliminary ejection K1 with an ejection frequency of 30 kHz of FIG. 10C, the required number of ejections was 5,000. It is confirmed from the above that the ejection performance recovery can be improved by raising the ejection frequency during the preliminary ejection K1 even at a smaller number of ejections.

As described above, executing the preliminary ejection K1 from the print head at the first temperature of 90° C. and raising the preliminary ejection frequency to more than the ejection frequency of the printing operation (15 kHz) were able to enhance the capability of removing bubbles formed at the end of the nozzle openings even at a smaller number of ejections.

(2) Condition of Preliminary Ejection K2 at Second Temperature

As shown in FIG. 11, during the preliminary ejection K2 in step 708 of FIG. 7, the ejection frequency and the number of ejections were changed. In this case, during the preliminary ejection K1 in step 705 of FIG. 7, the ejection frequency was held constant at 15 kHz and the number of ink ejections at 45,000.

The heating-based recovery operation of FIG. 7 was performed on the print head 102 in which bubbles 601 were formed as shown in FIG. 6. In some of eight nozzle openings 501 constituting the nozzle array 401, bubbles 601 were formed, ranging in number from one to eight depending on the magnitude of the impact the print head 102 received. After the heating-based recovery operation was performed on the print head 102, a predetermined pattern was printed to check how well the ink ejection performance was recovered. The print pattern used is such as will allow checking for a success or failure of ink ejection and a deflection of ink ejecting direction for each nozzle opening 501.

Marking "○" in FIG. 11 means that the bubbles 601 formed in the nozzle openings 501 were all removed and that the ink ejection performance has recovered. Marking "x" in FIG. 11 means that not all bubbles 601 formed in the nozzle openings 501 were removed and that the ink ejection performance has failed to be recovered.

From the result of FIG. 11 it is seen that, during the preliminary ejection K2, the larger the number of ink ejections, the greater the recovery effect is observed, as in the preliminary ejection K1. However, as far as the ejection frequency is concerned, a greater recovery effect is observed when the ejection frequency is lower than that of the printing operation (15 kHz), as opposed to the case of the preliminary ejection K1.

As described above, the capability of removing bubbles formed at the end of the nozzle openings was able to be enhanced even with a smaller number of ejections, by executing the preliminary ejection K2 from the print head kept at the second temperature of 50° C. and lowering the preliminary ejection frequency to less than the ejection frequency of the printing operation (15 kHz).

(3) Holding Time

In (1) and (2) described above, the heating hold time Tc in the heating hold sequence (step 703) of FIG. 7 was set to 5 seconds. Here, as shown in FIG. 12, the heating hold time Tc and the number of ejections during the preliminary ejection K1 in step 705 of FIG. 7 were varied. In this case, the ejection frequency of the preliminary ejection K1 in step 705 of FIG. 7 was held constant at 15 kHz and the number of ejections of the preliminary ejection K2 in step 708 of FIG. 7 was held constant at 45,000.

The print head 102 in which bubbles 601 were formed as shown in FIG. 6 was subjected to the heating-based recovery operation of FIG. 7. In some of eight nozzle openings 501 constituting the nozzle array 401, bubbles 601 were formed, ranging in number from one to eight depending on the magnitude of the impact applied to the print head 102. After the heating-based recovery operation was performed on the print head 102, a predetermined pattern was printed to check to what degree the ink ejection performance was recovered. The print pattern used is such as will allow checking for a success or failure of ink ejection and a deflection of ink ejecting direction for each nozzle opening 501.

Marking "○" in FIG. 12 means that the bubbles 601 formed in the nozzle openings 501 were all removed and that the ink ejection performance has recovered. Marking "x" in FIG. 12 means that not all bubbles 601 formed in the nozzle openings 501 were removed and that the ink ejection performance has failed to be recovered.

The result of FIG. 12 shows that as the heating hold time Tc increases, the recovery effect also improves even with a small number of ejections.

As described above, by heating the print head to the first temperature of 90° C. and setting the hold time of the first temperature (heating hold time Tc) long before executing the preliminary ejection K1, the bubbles formed at the end of the nozzle openings were able to be removed more effectively even with a fewer number of ejections. Further, increasing the ejection frequency of the preliminary ejection K1 was able to enhance the ejection performance recovery even with the smaller number of ejections.

(4) Set Temperature

In (1), (2) and (3) described above, the heating set temperatures (T1, T2) as the first temperature were set to 90° C. and the cooling set temperature as the second temperature was set to 50° C. Here, as shown in FIG. 13A, the heating set temperature as the first temperature and the number of ejections during the preliminary ejection K1 were changed and, as shown in FIG. 13B, the cooling set temperature as the second temperature and the number of ejections during the preliminary ejection K2 were changed.

The print head 102 in which bubbles 601 were formed as shown in FIG. 6 was subjected to the heating-based recovery operation of FIG. 7. In some of eight nozzle openings 501 constituting the nozzle array 401, bubbles 601 were formed, ranging in number from one to eight depending on the magnitude of the impact applied to the print head 102. After the heating-based recovery operation was performed on the print head 102, a predetermined pattern was printed to check how well the ink ejection performance was recovered. The print pattern used is such as will allow checking for a success or failure of ink ejection and a deflection of ink ejecting direction for each nozzle opening 501.

Marking "○" in FIG. 13A and FIG. 13B means that the bubbles 601 formed in the nozzle openings 501 were all removed and that the ink ejection performance has recovered. Marking "x" in FIG. 13A and FIG. 13B means that not all bubbles 601 formed in the nozzle openings 501 were removed and that the ink ejection performance has failed to be recovered.

First, a case in which the first temperature and the number of ejections of the preliminary ejection K1 were changed, as shown in FIG. 13A, will be explained. In this case, the ejection frequency of the preliminary ejection K1 was held constant at 15 kHz. The second temperature was held constant at 50° C. The ejection frequency and the number of ejections during the preliminary ejection K2 were held constant at 15 kHz and 45,000 respectively.

The result shown in FIG. 13A has found that, for the first temperature of 90° C., the number of ejections required in the preliminary ejection K1 to recover the normal ink ejection performance was 45,000. For the first temperature of 100° C., the number of ejections required in the preliminary ejection K1 was able to be reduced to 20,000. On the contrary, for the first temperature of 80° C., the number of ejections required in the preliminary ejection K1 increased to 60,000.

As described above, as the difference between the first temperature of the preliminary ejection K1, which is set high, and the second temperature of the preliminary ejection K2 increases, the ejection performance recovery can be enhanced even with a small number of ejections of the preliminary ejection K1.

Next, a case where the second temperature and the number of ejections in the preliminary ejection K2 were changed, as shown in FIG. 13B, will be explained. In this case, the ejection frequency of the preliminary ejection K2 was held constant at 15 kHz. The first temperature was held constant at 90° C. and the ejection frequency and the number of ejections in the preliminary ejection K1 were held constant at 15 kHz and 45,000, respectively.

The result shown in FIG. 13B has found that, when the second temperature was 50° C., 45,000 ejections were required during the preliminary ejection K2 to recover the ink ejection performance. When the second temperature was 40° C., the number of ejections required during the preliminary ejection K2 was able to be reduced to 20,000. On the contrary, when the second temperature was 60° C., the number of ejections required during the preliminary ejection K2 increased to 60,000.

As described above, as the difference between the second temperature of the preliminary ejection K2, which is set low, and the first temperature of the preliminary ejection K1 increases, the ejection performance recovery can be enhanced even with a small number of ejections.

From the results shown in FIG. 13A and FIG. 13B it is found effective to set the first and second temperatures as follows in enhancing the capability of removing bubbles at the end of nozzle openings. That is, the difference between the first temperature and the second temperature is increased by executing the preliminary ejection K1 at an elevated first temperature and the preliminary ejection K2 at a lowered second temperature, thus making it possible to improve the print head ejection performance recovery even with a reduced number of ejections during the preliminary ejections K1, K2.

Second Embodiment

The print head 102 in the first embodiment described above has the nozzle array 401 comprised of eight nozzle openings 501 each capable of ejecting about 5 pl of ink at a time, as shown in FIG. 4.

Figure 14:
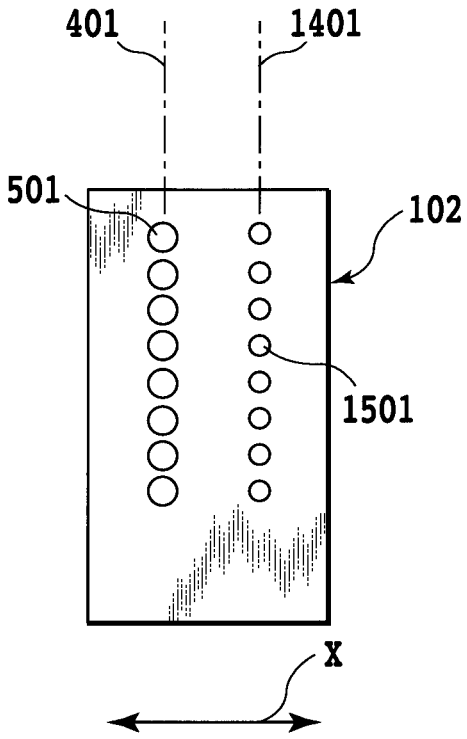
FIG. 14 is a schematic view showing an arrangement of nozzle openings in the print head of a second embodiment of this invention.

FIG. 14 shows a schematic view of the print head 102 of this embodiment, which is formed with a nozzle array 401 and a nozzle array 1401. The nozzle array 401 comprises eight nozzle openings (first nozzle openings) 501 each capable of ejecting ink droplets of about 5 pl (first volume). The nozzle array 1401 comprises eight nozzle openings (second nozzle openings) 1501 each capable of ejecting ink droplets of about 2 pl (second volume).

Figure 15:
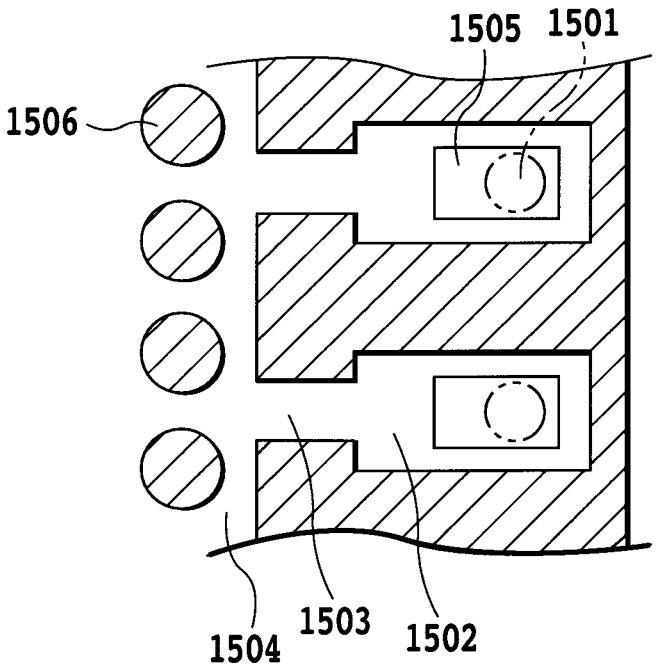
FIG. 15 is an enlarged cross-sectional view of a part of nozzle openings of FIG. 14.

FIG. 15 is a cross section of the nozzle array 1401 with the nozzle openings 1501 ejecting ink from the back of the sheet of this drawing toward the front. The nozzle openings 1501 each have an opening area through which 2 pl of ink droplet can be ejected. That is, they are each formed circular 10.4 μm in diameter. The dimensions of bubble chambers 1502 and ink paths 1503, both communicating to each nozzle opening 1501, and the dimension of heaters (electrothermal conversion elements) 1505 installed in each bubble chamber 1502 are adjusted according to the size of the nozzle openings 1501. Each of the heaters 1505 as ink ejection energy generation elements is installed in the bubble chambers 1502 in such a way as to oppose the associated nozzle opening 1501. Heating the heaters 1505 to create a bubble in the ink in the individual bubble chambers 1502 can cause an ink droplet to be ejected from the nozzle openings 1501 by an energy of the expanding bubbles.

More precisely, the bubble chamber 1502 is 22 μm wide and the ink path 2503 11 μm wide. The heater 1505 is rectangular in shape measuring 13×22.4 μm. A common liquid chamber 1504 is supplied with ink from an ink supply port not shown. A nozzle filter 1506 composed of pillars is installed in the common liquid chamber 1504 to trap extraneous substances or dirt in the ink supplied.

In this embodiment also, as in the preceding embodiment, the print head 102 in which bubbles 601 were formed was subjected to the heating-based recovery operation of FIG. 7 to check the degree of recovery of the ink ejection performance. There are bubbles 601 in the nozzle openings 501 of the print head 102 as shown in FIG. 6. Similarly, bubbles 601 are also formed in the nozzle openings 1501. In some of eight nozzle openings 1501 constituting the nozzle array 1401, bubbles 601 were formed, ranging in number from one to eight depending on the magnitude of the impact the print head 102 received, as in the case of the nozzle openings 501. After the heating-based recovery operation was performed on the print head 102, a predetermined pattern was printed to check to what degree the ink ejection performance was restored. The print pattern used is such as will allow checking for a success or failure of ink ejection and a deflection of ink ejecting direction for nozzle openings 501, 1501.

In this embodiment, as shown in FIG. 16, the numbers of ink ejections executed during the preliminary ejection K1 in step 705 of FIG. 7 from the nozzle openings 501, whose ejection volume is 5 pl, and from the nozzle openings 1501, whose ejection volume is 2 pl, were changed to check how effective they are in recovering the ejection performance of the print head 102. The numbers of ink ejections from the nozzle openings 501 and 1501 during the preliminary ejection K1 were set equal. In the preliminary ejection K2 in step 708 of FIG. 7, the ejection frequency was held constant at 15 kHz and the number of ink ejections at 45,000.

Marking "○" in FIG. 16 means that the bubbles formed in the nozzle openings 501, 1501 were all removed and that the ink ejection performance has recovered. Marking "x" in FIG. 16 means that not all bubbles were removed and that the ink ejection performance has failed to be recovered.

The result shown in FIG. 16 verifies that the ink ejection performance has failed to be recovered with "zero" ejections in the preliminary ejection K1 and that the degree of the ejection performance recovery can be improved by increasing the number of ejections.

It is also found that, for the nozzle openings 501 that eject about 5 pl of ink, 45,000 ejections were required as the number of ejections during the preliminary ejection K1 to recover the ejection performance. For the nozzle openings 1501 that eject about 2 pl of ink, 100,000 ejections were required during the preliminary ejection K1 to achieve the ejection performance recovery. These indicate that the smaller the inner diameter of the nozzle openings, the greater the number of ejections is required for the ejection performance recovery.

As described above, during the preliminary ejection K1 executed at the first temperature, setting the number of ink ejections from the large-diameter nozzle openings 501 smaller than that of the small-diameter nozzle openings 1501 can make the number of ejections optimal for the inner diameter of the nozzle openings. That is, for the large-diameter nozzle openings, the capability of removing bubbles at the end of the nozzle openings can be enhanced even with fewer ejections than those of the small-diameter nozzle openings.

Third Embodiment

The print head in the first and second embodiments uses electrothermal conversion elements (heaters) as ink ejection energy generation elements (print elements). The print elements may also be constructed of piezoelectric elements. In that case, it is necessary to have a heating element to raise the temperature of ink in the print head.

Figure 17:
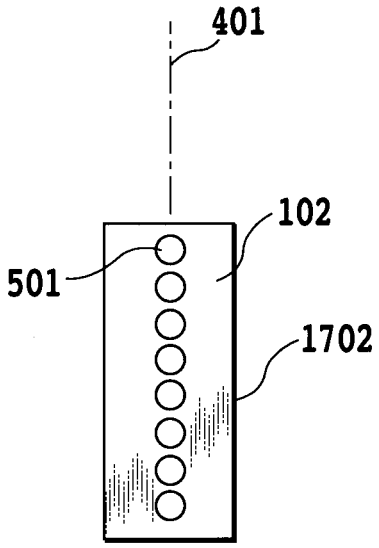
FIG. 17 is a schematic view showing an arrangement of nozzle openings in the print head of a third embodiment of this invention.

The print head 102 of this embodiment has a warming heater 1702 separate from the print elements, as shown in FIG. 17. In FIG. 17, a nozzle array 401 is shown to comprise eight nozzle openings 501 each capable of ejecting 5 pl of ink. Arranged to surround the nozzle array 401 is the warming heater 1702. The heating of ink by the warming heater 1702 is also referred to as a "warming by heater".

In this embodiment also, as in the preceding embodiments, the print head was subjected to the heating-based recovery operation of FIG. 7 to check how well the ejection performance of the print head was restored.

The heating-based recovery operation of FIG. 7 was performed on the print head 102 in which bubbles 601 were formed as shown in FIG. 6. In some of eight nozzle openings 501 constituting the nozzle array 401, bubbles 601 were formed, ranging in number from one to eight depending on the magnitude of the impact the print head 102 received. After the heating-based recovery operation was performed on the print head 102, a predetermined pattern was printed to check how well the ink ejection performance was recovered. The print pattern used is such as will allow checking for a success or failure of ink ejection and a deflection of ink ejecting direction for each nozzle opening 501.

Figure 18:
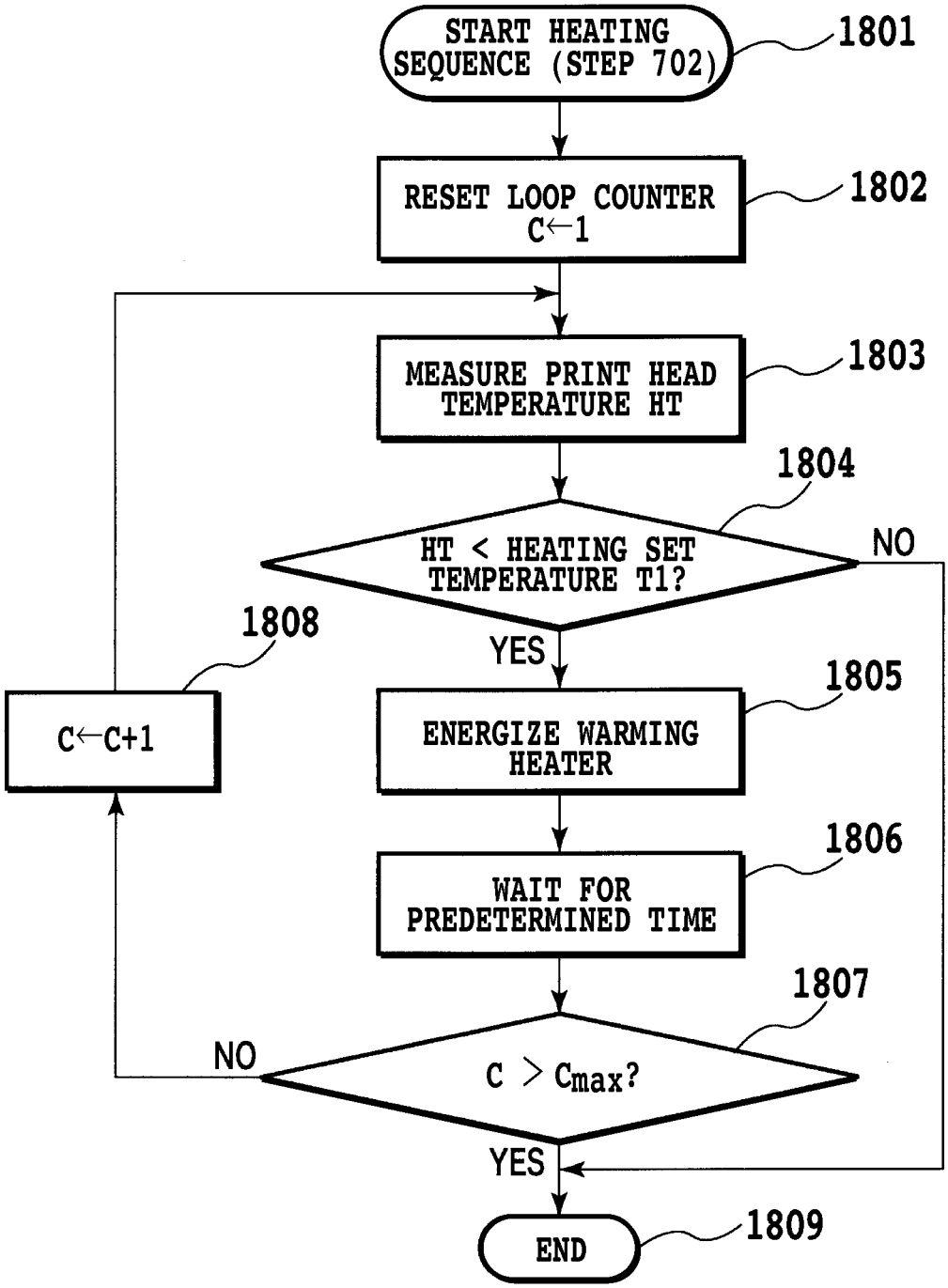
FIG. 18 is a flow chart of a heating sequence in the third embodiment of this invention.

FIG. 18 is a flow chart explaining the heating sequence executed by step 702 of FIG. 7. Steps 1801 to 1804 and steps 1806 to 1809 in FIG. 18 are identical with steps 801 to 804 and steps 806 to 809 in FIG. 8 of the preceding embodiment. In step 1805 of FIG. 18 the warming is executed by the warming heater 1702, i.e., by operating the warming heater 1702 for a predetermined period of time to heat the ink in the print head.

Figure 19:
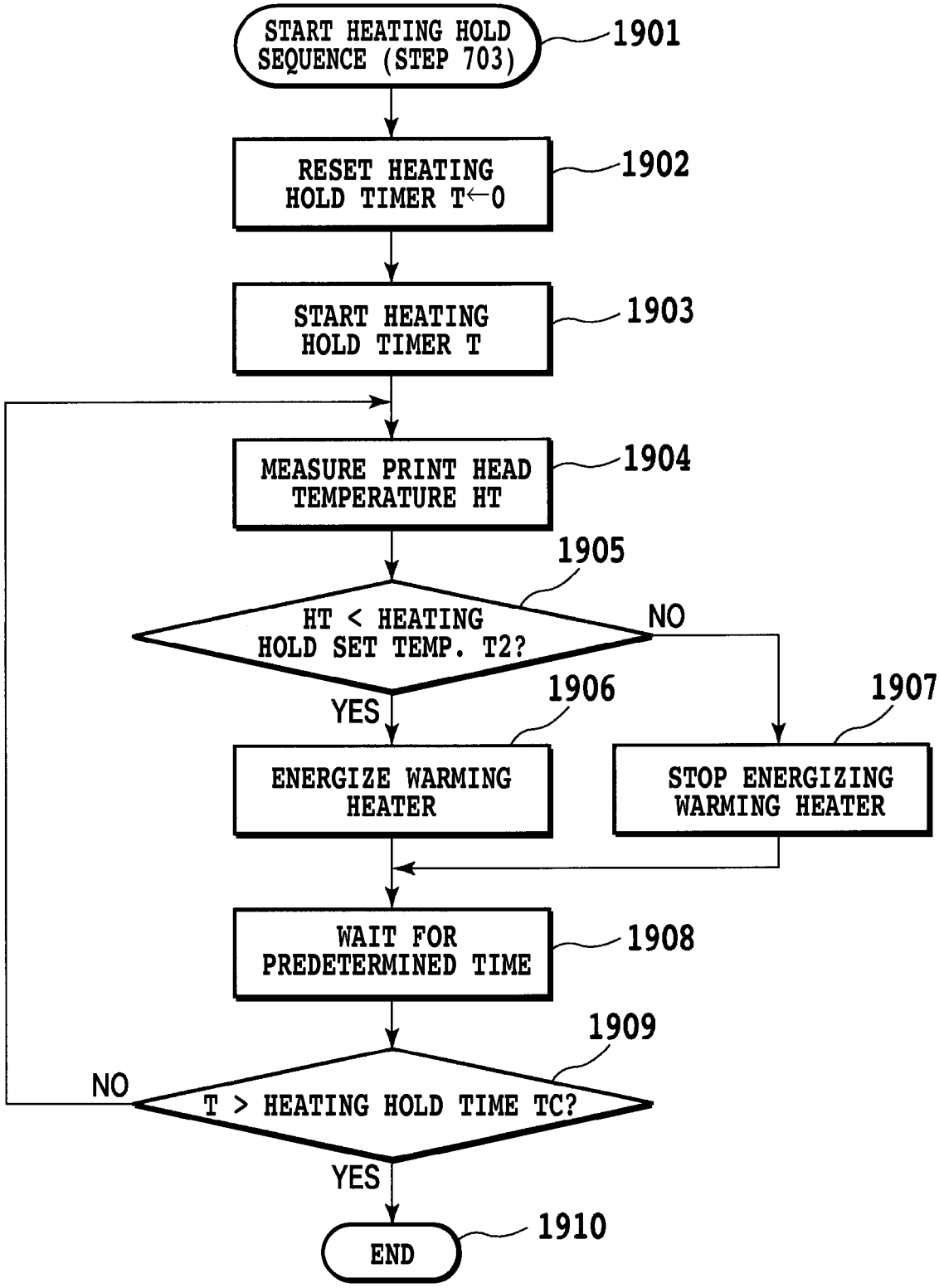
FIG. 19 is a heating hold sequence in the third embodiment of this invention.

FIG. 19 is a flow chart explaining the heating hold sequence in step 703 of FIG. 7. Steps 1901 to 1905 and steps 1908 to 1910 in FIG. 19 are identical with steps 901 to 905 and steps 908 to 910. In step 1906 of FIG. 19 the warming heater 1702 is operated to execute the warming and in step 1907 the warming by the warming heater 1702 is stopped.

In this embodiment the warming heater different from the printing elements intended to eject ink is used as means to heat ink. This arrangement can also produce an effect similar to that of the preceding embodiment.

Fourth Embodiment

Figure 20:
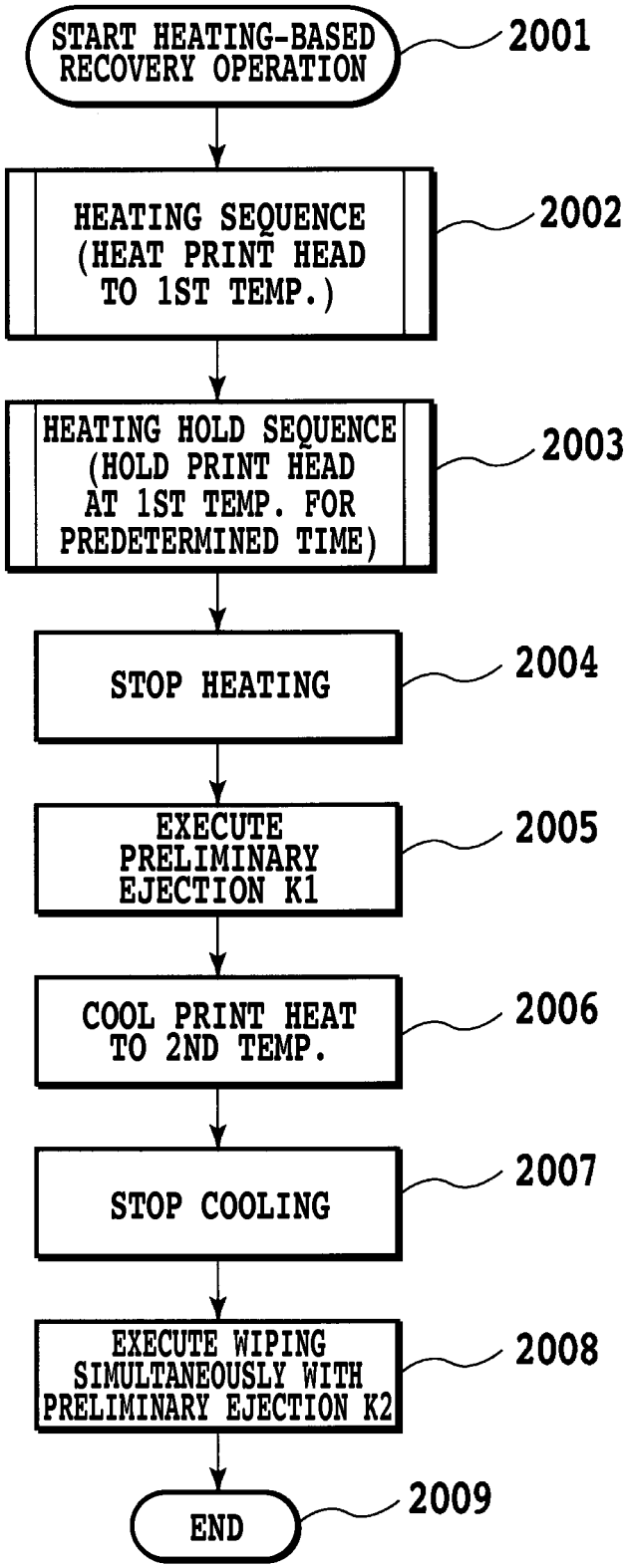
FIG. 20 is a flow chart of a heating-based recovery operation in a fourth embodiment of this invention.

In this embodiment, a heating-based recovery operation of FIG. 20 is performed instead of the heating-based recovery operation of FIG. 7 executed in the first to third embodiments.

Steps 2001 to 2007 in FIG. 20 are identical with steps 701 to 707 of FIG. 7. At step 2008 of FIG. 20 a wiping operation is performed simultaneously with the preliminary ejection K2.

Figure 21:
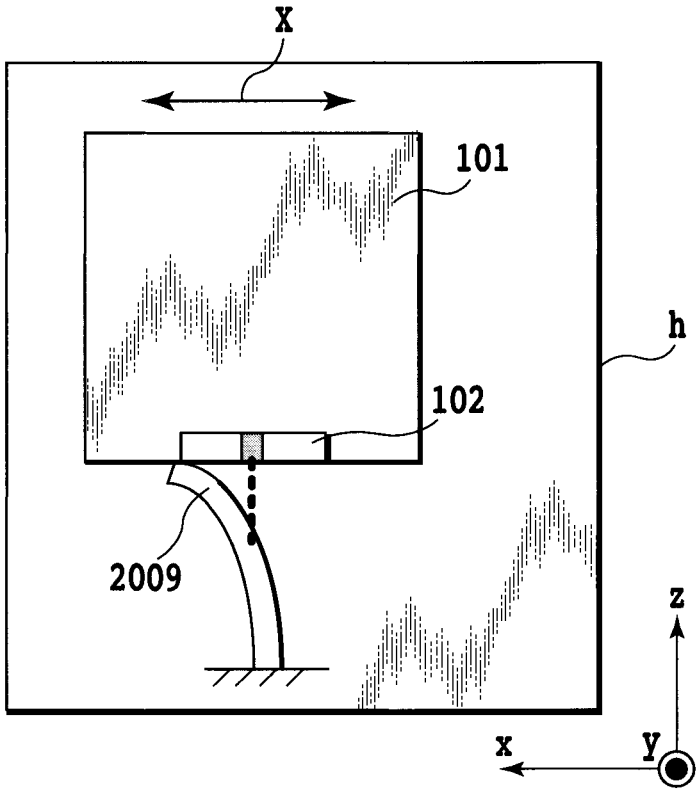
FIG. 21 is a schematic view showing a wiping operation in FIG. 20.

FIG. 21 is a schematic view showing the operation of step 2008. FIG. 21 shows the head cartridge 101 at the home position h, as seen from a direction of +y in FIG. 1. At step 2008, the head cartridge 101 moves in the +x direction at a speed slower than that of printing (e.g., 5 inches/sec) while at the same time executing the preliminary ejection K1 from the print head 102. At this time, the print head 102 is put in contact with an elastic blade 2009 provided at the home position h so that the blade 2009 wipes the nozzle opening-formed surface of the print head 102 as shown in FIG. 21. The wiping may be done by moving the blade 2009 relative to the print head 102.

In this embodiment the sequences of FIG. 8 and FIG. 9 are executed as the heating sequence of step 2002 and the heating hold sequence of step 2003.

In this embodiment the heating-based recovery operation of FIG. 20 was performed on the print head to check how well the ink ejection performance was restored.

The heating-based recovery operation of FIG. 20 was performed on the print head 102 in which bubbles 601 were formed as shown in FIG. 6. In some of eight nozzle openings 501 constituting the nozzle array 401, bubbles 601 were formed ranging in number from one to eight depending on the magnitude of the impact the print head 102 received. After the heating-based recovery operation was performed on the print head 102, a predetermined pattern was printed to check how well the ink ejection performance was recovered. The print pattern used is such as will allow checking for a success or failure of ink ejection and a deflection of an ink ejection direction for each nozzle opening 501.

As shown in FIG. 22, during the preliminary ejection K2 in step 2008 of FIG. 20, the ejection frequency and the number of ejections executed were changed. In the preliminary ejection K1 in step 2005 of FIG. 20, the ejection frequency was held constant at 15 kHz and the number of ejections at 45,000.

Marking "○" in FIG. 22 means that the bubbles 601 formed in the nozzle openings 501 were all removed and that the ink ejection performance has recovered. Marking "x" in FIG. 22 means that not all bubbles 601 formed in the nozzle openings 501 were removed and that the ink ejection performance has failed to be recovered.

The result shown in FIG. 22 was compared with that of FIG. 11 in the preceding embodiment.

From the result shown in FIG. 11 it is seen that the number of ink ejections required to recover the ejection performance of the print head was 45,000 when the ejection frequency during the preliminary ejection K2 was 15 kHz. On the contrary, FIG. 22 shows that the number of ejections required for recovery was 500 when the ejection frequency of the preliminary ejection K2 was 15 kHz.

The result of FIG. 11 shows that when the ejection frequency of the preliminary ejection K2 was 30 kHz, 45,000 ink ejections were not enough to restore the normal ink ejection performance. However, the result of FIG. 22 shows that when the ejection frequency of the preliminary ejection K2 was 30 kHz, the normal ejection performance was able to be restored even with only 3,000 ejections.

As described above, performing the wiping operation simultaneously with the preliminary ejection K2 can remove a part of the bubbles remaining at the end of the nozzle openings. This explains why the ejection performance recovery is verified to be able to be improved even with a smaller number of ink ejections. During a single wiping operation, 500 ink ejections are executed by the 15-kHz preliminary ejection K2. So, during the 30-kHz preliminary ejection K2, 1,000 ink ejections were executed during one wiping operation. Repeating this operation three times results in 3,000 ejections.

In this embodiment, as described above, the sequences of FIG. 8 and FIG. 9 are executed as the heating sequence of step 2002 and as the heating hold sequence of step 2003. It is also possible to produce the similar effect by executing the sequences of FIG. 18 and FIG. 19.

Performing the wiping operation simultaneously with the preliminary ejection K2 at the second temperature, as described above, was able to enhance the capability of removing bubbles at the end of the nozzle openings.

Fifth Embodiment

The constructions described in the preceding embodiments have no suction pump to perform a suction-based recovery operation. In this embodiment, an example application of a construction having such a suction pump is explained. The print head used in this embodiment is the print head 102 of FIG. 4.

Figure 23:
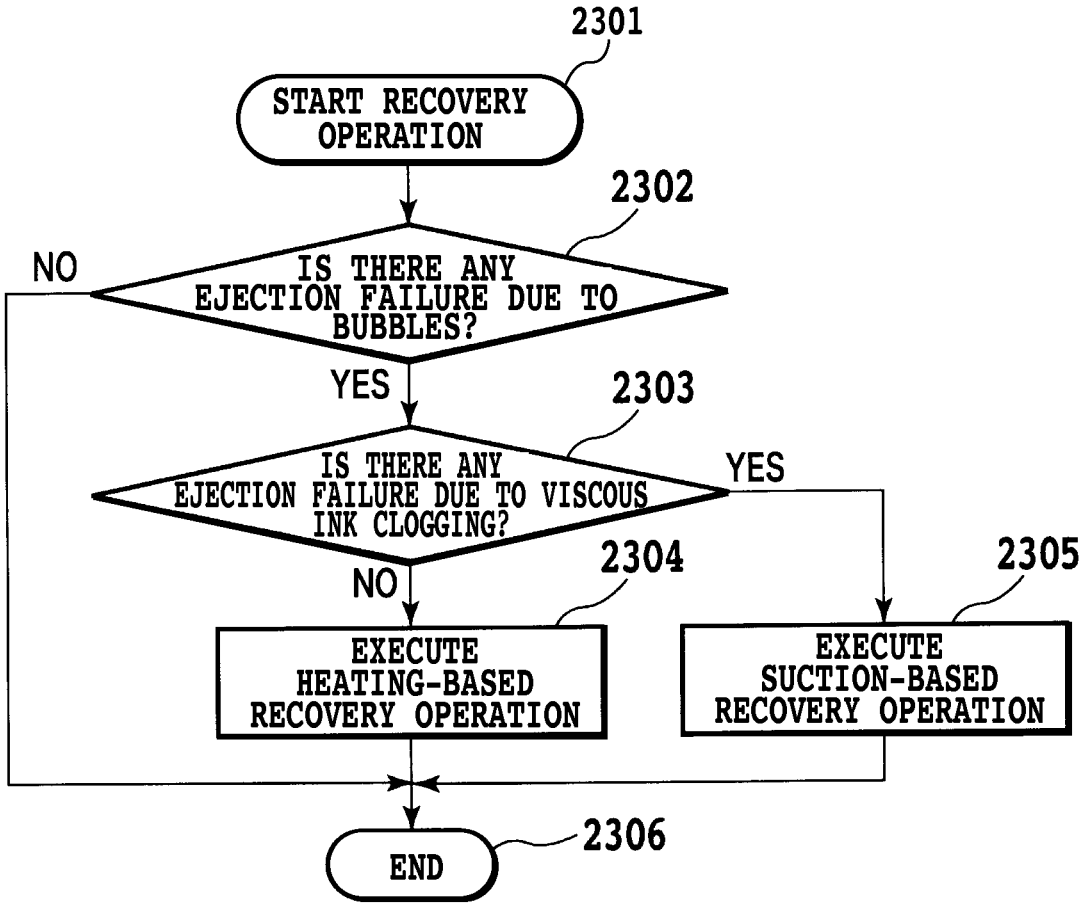
FIG. 23 is a flow chart explaining a recovery operation in a fifth embodiment of this invention.

FIG. 23 shows a flow chart to explain a recovery operation executed in this embodiment when an ejection failure due to the formation of bubbles 601 of FIG. 6 has occurred.

At step 2301 the recovery operation is started. At step 2302 a check is made to see if an ejection failure caused by the formation of bubbles 601 has occurred. If no ink ejection failure is found, the recovery operation is ended at step 2306. If the ejection failure is detected, another check is made at step 2303 to see whether the ejection failure is caused by viscous ink clogging the nozzle openings 501. If such an ejection failure is not found, the heating-based recovery operation is executed at step 2304 before ending it at step 2306. If there is such an ejection failure, the suction-based recovery operation is executed at step 2305 before exiting the sequence at step 2306.

The heating-based recovery operation executed at step 2304 is the heating-based recovery operation explained in FIG. 7 in the first to third embodiments or the heating-based recovery operation of FIG. 20 in the fourth embodiment.

The suction-based recovery operation executed at step 2305 is the one that sucks out from the nozzle openings the ink not contributing to image printing. More specifically, the print head 102 is capped with a cap 2010 (see FIG. 2) to hermetically close the nozzle openings 501 and a negative pressure created by the suction pump is introduced into the interior of the tightly closed cap 2010. The negative pressure applied causes ink, bubbles 601 formed in the nozzle openings 501 and viscous ink adhering to the surrounding of the nozzle openings 501 to be discharged from the print head into the cap 2010.

After the ink has been drawn out into the cap 2010, the cap 2010 is released from the print head 102 to open the nozzle openings 501 and is subjected to an open suction operation to discharge the sucked-out ink from the cap 2010. After the suction-based recovery operation is done, the surface of the print head 102 where the nozzle openings 501 are formed (nozzle opening-formed surface) is wiped with the blade 2009 (see FIG. 21) to remove ink adhering to the nozzle opening-formed surface. This keeps the ink ejection state in a normal state.

Suppose bubbles 601 exist in six out of eight nozzle openings 501 of the print head 102 and that the remaining two nozzle openings 501 are clogged with viscous ink. This print head 102 was subjected to the recovery operation of FIG. 23 and a predetermined pattern was printed in order to check how well the ink ejection performance of the print head 102 was restored. The print pattern used is such as will allow checking for a success or failure of ink ejection and a deflection of ink ejection direction for each nozzle opening 501.

FIG. 24 shows results of check made following the heating-based recovery operation of step 2304 and the suction-based recovery operation of step 2305.

Values shown in FIG. 24 represent a recovery rate which is defined by an equation presented below, or a percentage of those nozzle openings that were unable to eject ink but have recovered their ink ejection capability.

Recovery rate=(the number of nozzle openings recovered by recovery operation)/(the number of failed nozzle openings before recovery operation)

FIG. 24 shows a recovery rate of those nozzle openings that failed due to bubbles 601, a recovery rate of those that failed due to clogging by viscous ink, and a sum of these recovery rates. Before the recovery operation, "6" nozzle openings 501 failed because of the bubbles 601 and "2" nozzle openings 501 failed because of clogging by viscous ink, as described above.

From the result of FIG. 24, it is seen that the heating-based recovery operation of step 2304 has resulted in a recovery rate of 100% (6/6) for the six nozzle openings 501 that failed because of the bubbles 601 but, for the two nozzle openings 501 that failed because of clogging by viscous ink, has resulted in a recovery rate of 0% (0/2). The suction-based recovery operation of step 2305 has produced not only a recovery rate of 100% (6/6) for the six nozzle openings 501 that failed because of the bubbles 601 but also a recovery rate of 100% (2/2) for the two nozzle openings 501 that failed because of clogging by viscous ink.

The two nozzle openings 501 that failed because of clogging by viscous ink were not able to be recovered even by repeated execution of the heating-based recovery operation of step 2304.

Where there are ejection failures due to clogging of nozzle openings by viscous ink in addition to ejection failures caused by the bubbles 601, this embodiment does not perform the heating-based recovery operation of step 2304 but executes the suction-based recovery operation of step 2305. This can efficiently restore the failed nozzle openings to normal.

Nozzle openings are likely to be clogged by viscous ink when, for example, the print head has not been mounted in the printing apparatus for a long period and when the print head mounted in the printing apparatus has been left unused without being covered with the cap 2010 for a long period.

As described above, in this embodiment the suction-based recovery operation that sucks out ink from the nozzle openings by using the suction pump installed in the ink jet printing apparatus and the heating-based recovery operation are selectively performed. This arrangement can effectively recover the failed nozzle openings to normal even if they are clogged with viscous ink.

Other Embodiments

This invention can be applied to a wide range of ink jet printing apparatus that print images using a print head capable of ejecting ink from its nozzle openings. Therefore, the ink jet printing apparatus is not limited to a serial scan type such as shown in FIG. 1 but may be applied to a full line type that prints an image without moving the print head.

Means (unit) for measuring the temperature of ink within the print head may be one that measures a print head temperature that matches the temperature of ink in the print head, or one that directly measures the ink temperature. What is required is to be able to practically measure the ink temperature in the print head. The means to heat the ink in the print head may be constructed to directly or indirectly heat the ink in the print head.

Further, the print head may have two kinds of nozzle openings of different sizes so that the number of ink ejections executed during the first preliminary ejection can be appropriately changed according to the sizes of the nozzle openings.

The control function that involves executing the first preliminary ejection after having heated the ink temperature in the print head to the first temperature and then, when the print head interior temperature falls to the second temperature, executing the second preliminary ejection may all or partly be provided on the side of the printing apparatus or host device. For example, all or a part of the control function may be executed by the CPU 2000 on the printing apparatus side or by the host device that supplies print images to the printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-078911, filed Mar. 25, 2008, and Japanese Patent Application No. 2009-033110, filed Feb. 16, 2009, which are hereby incorporated by reference herein in their entirety.

What is claimed is:

1. An ink jet printing apparatus comprising:

a print head having a nozzle opening for ejecting ink;

a heating unit that heats the print head;

a first control unit configured to control a preliminary ejection operation of the print head to eject ink not contributing to printing an image on a print medium; and a second control unit configured to control an ink ejecting operation of the print head to print the image on the print medium, wherein the second control unit performs the ink ejection operation after the preliminary ejection operation performed by the first control unit, wherein the first control unit performs a first operation and a second operation as the preliminary ejection operation, the first operation being performed, after the print head is heated to a first temperature by the heating unit, to eject ink not contributing to printing the image, and the second operation being performed, after waiting until the print head cools down to a second temperature lower than the first temperature, to eject ink not contributing to printing the image, wherein an ink ejection frequency during the first operation is higher than an ink ejection frequency used for printing the image, and wherein an ink ejection frequency during the second operation is lower than or equal to an ink ejection frequency used for printing the image.

2. The ink jet printing apparatus according to claim 1, wherein during the second operation a surface of the print head where the nozzle opening is formed is wiped simultaneously with the ink ejection from the nozzle opening.

3. The ink jet printing apparatus according to claim 1, further comprising:

a suction-based recovery unit that sucks out ink not contributing to printing the image from the nozzle opening and discharge it to the outside.

4. The ink jet printing apparatus according to claim 1, wherein the second control unit does not perform the ink ejecting operation during the preliminary ejection operation.

5. An ink jet printing apparatus comprising:

a print head having a nozzle opening for ejecting ink;

a heating unit that heats the print head;

a first control unit configured to control a preliminary ejection operation of the print head to eject ink not contributing to printing an image on a print medium; and a second control unit configured to control an ink ejecting operation of the print head to print the image on the print medium, wherein the second control unit performs the ink ejection operation after the preliminary ejection operation performed by the first control unit, wherein the first control unit sequentially performs a first operation and a second operation as the preliminary ejection operation without executing the ink ejection operation in between, the first operation being performed, after the print head is heated to a first temperature by the heating unit, to eject ink not contributing to printing the image, and the second operation being performed, after waiting until the print head cools down to a second temperature lower than the first temperature, to eject ink not contributing to printing the image, wherein an ink ejection frequency during the first operation is higher than an ink ejection frequency used for priming the image, and wherein an ink ejection frequency during the second operation is lower than or equal to an ink ejection frequency used for priming the image.

6. The ink jet printing apparatus according to claim 5, wherein during the second operation a surface of the print head where the nozzle opening is formed is wiped simultaneously with the ink ejection from the nozzle opening.

7. The ink jet printing apparatus according to claim 5, further comprising:

a suction-based recovery unit that sucks out ink not contributing to printing the image from the nozzle opening and discharge it to the outside.

8. The ink jet printing apparatus according to claim 5, wherein the second control unit does not perform the ink ejecting operation during the preliminary ejection operation.

* * * * *